US009362098B2

(12) United States Patent
Jarrell

(10) Patent No.: US 9,362,098 B2
(45) Date of Patent: Jun. 7, 2016

(54) ION OPTICAL ELEMENT

(71) Applicant: Waters Technologies Corporation, Milford, MA (US)

(72) Inventor: Joseph A. Jarrell, Newton Highlands, MA (US)

(73) Assignee: Waters Technologies Corporation, Milford, MA (US)

( * ) Notice: Subject to any disclaimer, the term of this patent is extended or adjusted under 35 U.S.C. 154(b) by 0 days.

(21) Appl. No.: 14/579,038

(22) Filed: Dec. 22, 2014

(65) Prior Publication Data

US 2015/0179421 A1 Jun. 25, 2015

Related U.S. Application Data

(60) Provisional application No. 61/920,640, filed on Dec. 24, 2013.

(51) Int. Cl.

| | |
|---|---|
| ***H01J 49/40*** | (2006.01) |
| ***H01J 49/26*** | (2006.01) |
| ***H01J 49/00*** | (2006.01) |
| ***H01J 27/00*** | (2006.01) |
| ***H01J 49/06*** | (2006.01) |

(52) U.S. Cl.

CPC ..... *H01J 49/06* (2013.01); *H01J 49/405* (2013.01)

(58) Field of Classification Search

None

See application file for complete search history.

(56) References Cited

U.S. PATENT DOCUMENTS

| | | | |
|---|---|---|---|
| 3,937,954 | A | 2/1976 | Fite |
| 4,013,887 | A | 3/1977 | Fite |
| 4,234,791 | A | 11/1980 | Enke et al. |
| 4,390,784 | A | 6/1983 | Browning et al. |
| 4,542,293 | A | 9/1985 | Fenn et al. |
| 5,608,217 | A | 3/1997 | Franzen et al. |
| 5,736,740 | A | 4/1998 | Franzen |
| 5,847,386 | A | 12/1998 | Thomson et al. |

(Continued)

FOREIGN PATENT DOCUMENTS

| | | | |
|---|---|---|---|
| WO | 2011133817 | A1 | 10/2011 |
| WO | 2014194172 | A2 | 10/2011 |

OTHER PUBLICATIONS

Carrico et al., "Simple Electrode Design for Ion Mobility Spectrometer," J. Phys. E: Sci. Instrum., vol. 16 (1983) Great Britain, 1058-1062.

*Primary Examiner* — Bernard E Souw

(74) *Attorney, Agent, or Firm* — Waters Technologies Corporation

(57) ABSTRACT

An ion optical element that may be used as an ion guide in a mass spectrometer, as a reflectron in a time-of-flight mass spectrometer, as an ion mobility drift tube in an ion mobility spectrometer, or as a collision cell or reaction cell in a mass spectrometer. The ion optical element has an inner tube made of a first ceramic material within an outer ceramic tube made of a second ceramic material. The electrical resistivity of the second ceramic material is two orders of magnitude or more higher than the electrical resistivity of the first ceramic material. In certain embodiments, the thermal conductivity of the second ceramic material is at least about an order of magnitude higher than the thermal conductivity of the first ceramic material.

21 Claims, 15 Drawing Sheets

(56) References Cited

U.S. PATENT DOCUMENTS 6,359,275 B1 3/2002 Bertsch et al.
6,486,469 B1 11/2002 Fischer et al.
6,576,897 B1 6/2003 Steiner et al.
6,803,585 B2 * 10/2004 Glukhoy ..... H01J 27/18 204/192.15
6,812,453 B2 11/2004 Bateman et al.
6,943,347 B1 * 9/2005 Willoughby ..... H01J 49/0404 250/288
7,060,987 B2 * 6/2006 Lee ..... H01J 49/147 134/1
7,081,618 B2 7/2006 Laprade
7,154,086 B2 12/2006 Laprade
7,547,891 B2 * 6/2009 Mordehai ..... H01J 49/0095 250/281
7,705,296 B2 * 4/2010 Wu ..... G01N 27/622 250/281
7,943,901 B2 * 5/2011 Wu ..... H01J 49/004 250/281
8,084,732 B2 12/2011 Laprade
8,314,383 B2 * 11/2012 Wu ..... G01N 27/622 250/281
8,552,366 B2 10/2013 Hoyes
2003/0234369 A1 * 12/2003 Glukhoy ..... H01J 27/18 250/423 R
2004/0238755 A1 * 12/2004 Lee ..... H01J 49/147 250/423 R
2007/0278396 A1 * 12/2007 Wu ..... G01N 27/622 250/282
2008/0121797 A1 * 5/2008 Wu ..... H01J 49/004 250/283
2011/0183431 A1 * 7/2011 Covey ..... G01N 27/624 436/173
2011/0210244 A1 * 9/2011 Wu ..... H01J 49/004 250/283
2012/0199736 A1 8/2012 Danel et al.
2012/0298853 A1 * 11/2012 Kurulugama ..... H01J 49/065 250/282
2013/0009053 A1 * 1/2013 Wu ..... H01J 49/004 250/282
2014/0326870 A1 * 11/2014 Makarov ..... H01J 49/06 250/283

* cited by examiner

ION OPTICAL ELEMENT

CROSS-REFERENCE TO RELATED APPLICATION

This application claims priority to and benefit of U.S. Provisional Application No. 61/920,640 filed Dec. 24, 2013, the contents and teachings of which are incorporated herein by reference in their entirety.

BACKGROUND

The present embodiments relate generally to ion optical elements that may be used, for example, in time-of-flight mass spectrometers, ion mobility spectrometers, ion guides, collision cells, reaction cells or other instruments.

Time-of-flight mass spectrometers (TOFs) can be used to separate ions and determine their mass-to-charge ratios. In a linear TOF, ions are rapidly accelerated through a potential difference to a set kinetic energy and then travel in a straight line down a flight tube. The arrival of the ions at the far end of the flight tube is detected, typically with a microchannel plate or a very fast electron multiplier. If different ions have different masses, the lighter ions travel faster and arrive at the detector sooner. The difference in time-of-arrival may be used as a measure of the mass-to-charge ratio (m/z) of the ions. TOF mass spectrometers are described in, for example, U.S. Pat. Nos. 7,154,086 and 8,084,732 which are incorporated herein in their entireties.

Ion mobility spectrometers (IMS) may also be used to separate and identify analyte ions. Unlike time-of-flight mass spectrometers, which operate in a high vacuum such that collisions with background gas can be neglected, ion mobility devices operate at atmospheric pressure or at vacuum levels poor enough that analyte ions are constantly losing kinetic energy through collisions with the background gas. Because the size, shape and mass of an analyte ion affects its mobility, ion mobility spectrometers measure the transit time for an ion to travel a set distance. Since the motion of an ion is constantly damped, the ions are typically subjected to an electric field as they travel through the IMS. An IMS typically comprises a series of equally-spaced rings with an equal voltage drop between each pair of rings. Such a device is depicted FIGS. 1 and 2 in U.S. Pat. No. 7,081,618, which is incorporated by reference herein in its entirety.

Ion guides, collision cells and reaction cells may be used as components in mass spectrometers. Ion guides may be used as a component in TOF or quadrupole mass spectrometers to transport ions through different stages of the mass spectrometer system. An example of an ion guide is described in U.S. Pat. No. 6,812,453 which is incorporated by reference herein in its entirety.

Collision cells may be used to fragment ions in a sample in order to determine their structure or to achieve more sensitive or more specific analyses. A simple collision cell is described in U.S. Pat. No. 4,234,791, which is incorporated by reference herein in its entirety. In a collision cell, radio frequency (RF) fields are used to confine ions radially as they travel through a quadrupole, hexapole or other multipole ion guide. The gas pressure inside the ion guide is raised and ions are injected into the ion guide with enough energy to cause fragmentation of the ions when they collide with the neutral gas molecules inside the collision cell. These ion fragments can then be analyzed by a mass analyzer. In many cases, it has been found useful to provide an axial electric field to keep ions moving through and out of the collision cell. Various means for providing such an axial field are described in U.S. Pat. No. 5,847,386, which is also incorporated by reference in its entirety herein.

Reaction cells are generally structurally similar to collision cells, but use a reaction gas such as ammonia, methane, oxygen or hydrogen (or mixtures of reaction gases) that react with the sample to reduce or eliminate isobaric interferences.

SUMMARY

Embodiments of ion optical elements disclosed herein can be used as a variety of devices in mass spectrometry and related systems, such as ion guides, reflectrons, collision cells, reaction cells and ion mobility drift tubes. These embodiments have an inner ceramic tube made of a first ceramic material concentrically within a second ceramic tube made of a second ceramic material. The second ceramic tube has an electric heater, either embedded within the second ceramic tube or encircling the second ceramic tube. The first ceramic tube is in close thermal contact with the second ceramic tube, such that when the second ceramic tube is heated to an elevated temperature, the first ceramic tube is also heated to that elevated temperature, because both the first ceramic tube and the second tube are made of materials that are good thermal conductors. The room temperature electrical resistivity of the second ceramic material is at least two orders of magnitude higher than the room temperature electrical resistivity of the first ceramic material.

The embodiments of the ion optical element disclosed herein include an embodiment with an outer ceramic tube made of a second ceramic material and an inner ceramic tube made of a first ceramic material within and concentric to the outer ceramic tube. The inner ceramic tube fits closely within the outer ceramic tube and is in thermal contact with the outer ceramic tube. An electric heater is configured to heat the outer ceramic tube. There is a first conductive element at an entrance end of the inner ceramic tube. A DC voltage power supply applies a DC voltage between the entrance end of the inner ceramic tube and an opposite end of the inner ceramic tube. The first ceramic material is characterized by a first room temperature electrical resistivity and a first room temperature thermal conductivity, and the second ceramic material is characterized by a second room temperature electrical resistivity and a second room temperature thermal conductivity. The second room temperature electrical resistivity is higher than the first room temperature electrical resistivity by at least two orders of magnitude. In certain embodiments, the thermal conductivity of the second ceramic material has a thermal conductivity that is at least about an order of magnitude higher than the thermal conductivity of the first ceramic material.

Embodiments also include a mass spectrometer with an ion guide within a first chamber configured to direct ions towards a pusher plate in a second chamber. It has a stack of ring electrodes within the second chamber. The pusher plate is configured to be pulsed to a high voltage with respect to a first ring electrode in the stack of ring electrodes such that the ions are accelerated into a flight tube in the second chamber and then into an ion optical element within the second chamber. The ion optical element includes an outer ceramic tube made of a second ceramic material and an inner ceramic tube made of a first ceramic material within the outer ceramic tube. The inner ceramic tube is dimensioned to fit closely within the outer ceramic tube and is in thermal contact with the outer ceramic tube. An electric heater heats the outer ceramic tube. A DC voltage power supply applies a DC voltage between an entrance end of the inner ceramic tube and an opposite end of the inner ceramic tube. The first ceramic material is characterized by a first room temperature electrical resistivity and a first room temperature thermal conductivity, and the second ceramic material is characterized by a second room temperature electrical resistivity and a second room temperature thermal conductivity. The second room temperature electrical resistivity is higher than the first room temperature electrical resistivity by at least two orders of magnitude. In certain embodiments, the second room temperature thermal conductivity is higher than the first room temperature thermal conductivity by at least about an order of magnitude.

Embodiments also include an ion optical element with an outer ceramic tube made of a second ceramic material and an inner ceramic tube made of a first ceramic material within the outer ceramic tube. The inner ceramic tube fits closely within the outer ceramic tube and is in thermal contact with the outer ceramic tube. An electric heater heats the outer ceramic tube. There is a first conductive element at an entrance end of the inner ceramic tube, and an end plate at the opposite end of the inner ceramic tube. A DC voltage power supply applies a DC voltage between the first conductive element and the end plate. The polarity of the DC power supply is selected such that the end plate repels ions entering the ion optical element. The first ceramic material is characterized by a first room temperature electrical resistivity and a first room temperature thermal conductivity. The second ceramic material is characterized by a second room temperature electrical resistivity and a second room temperature thermal conductivity. The second room temperature electrical resistivity is higher than the first room temperature electrical resistivity by at least two orders of magnitude, and the second room temperature thermal conductivity is higher than the first room temperature thermal conductivity by at least about an order of magnitude.

Embodiments also include an ion mobility drift tube with an outer ceramic tube made of a second ceramic material and an inner ceramic tube made of a first ceramic material within the outer ceramic tube. The inner ceramic tube is in close thermal contact with the outer ceramic tube. An electric heater is configured to heat the outer ceramic tube. There is a first conductive element mounted at an entrance end of the inner ceramic tube and a second conductive element mounted at an exit end of the inner ceramic tube. The drift tube also has a port for introducing a counterflow of gas into the inner ceramic tube. It has a DC voltage power supply applying a DC voltage between the first conductive element and the second conductive element. The DC voltage is selected to drive the ions through the counterflow of gas towards the exit end of the inner ceramic tube. The first ceramic material is characterized by a first room temperature electrical resistivity and a first room temperature thermal conductivity. The second ceramic material is characterized by a second room temperature electrical resistivity and a second room temperature thermal conductivity. The second room temperature electrical resistivity is higher than the first room temperature electrical resistivity by two orders of magnitude or more. In certain embodiments, the second room temperature thermal conductivity is higher than the first room temperature thermal conductivity by about an order of magnitude or more.

Embodiments also include an ion optical element with an outer ceramic tube made of a second ceramic material and an inner ceramic tube made of a first ceramic material within the outer ceramic tube and concentric to the outer ceramic tube. The inner ceramic tube is in close thermal contact with the outer ceramic tube. The ion optical element has a conductive entrance plate with an entrance orifice at an entrance end of the inner ceramic tube and a conductive exit plate having an exit orifice at an exit end of the inner ceramic tube. It has an electric heater configured to heat the outer ceramic tube. It also has a first pair of opposing electrodes extending substantially along the length of the second ceramic tube and disposed opposite each other, and a second pair of opposing electrodes extending substantially along the length of the outer ceramic tube and disposed opposite each other. The electrodes of the second pair of opposing electrodes are placed at the circumference of the outer ceramic tube at positions that are halfway between the positions of the first pair of opposing electrodes. A DC voltage power supply applies a DC voltage between the entrance end of the inner ceramic tube and the exit end of the inner ceramic tube. An RF source is capacitively coupled at a first phase to the first pair of opposing electrodes and is also capacitively coupled at a second phase to the second pair of opposing electrodes. The second phase is 180° out-of-phase with the first phase. The ion optical element has a port for introducing one of a collision gas and a reaction gas into the interior of the inner ceramic tube. The first ceramic material is characterized by a first room temperature electrical resistivity and a first room temperature thermal conductivity, and the second ceramic material is characterized by a second room temperature electrical resistivity that is higher than the first room temperature electrical resistivity by at least two orders of magnitude. In certain embodiments, the second ceramic material is characterized by a second room temperature thermal conductivity that is higher than the first room temperature thermal conductivity by at least about an order of magnitude.

Another embodiment is a reflectron for a mass spectrometer that has an outer ceramic tube with an electric heater. It has an inner tube within the outer ceramic tube which is in close thermal contact with the outer ceramic tube. The inner tube is comprised of at least five sets of alternating metal ring electrodes and ceramic rings. The reflectron has an entrance grid at an entrance end of the inner ceramic tube and an end plate at an opposite end of the inner ceramic tube. It also has a high voltage power supply applying a high voltage between the entrance grid and the end plate. The high voltage is selected such that the end plate repels ions. The ceramic rings are made of a first ceramic material that is characterized by a first room temperature electrical resistivity and by a first room temperature thermal conductivity. The outer ceramic tube is made of a second ceramic material that is characterized by a second room temperature electrical resistivity and a second room temperature thermal conductivity. The second room temperature electrical resistivity is higher than the first room temperature electrical resistivity by at least two orders of magnitude. In certain embodiments, the second room temperature thermal conductivity is higher than the first room temperature thermal conductivity by at least one order of magnitude.

Another embodiment is an ion optical element with an inner ceramic tube concentrically positioned within an outer ceramic tube and in close thermal contact with the outer ceramic tube. It has an electrical heater embedded in the outer ceramic tube. It also has an entrance plate at an entrance end of the inner ceramic tube and an exit plate at an exit end of the inner ceramic tube. The entrance plate has an entrance orifice and the exit plate has an exit orifice. The ion optical element has a port for introducing either a collision gas or a reaction gas into the inner chamber formed by the inner ceramic tube, the entrance plate and the exit plate. It has a DC power supply electrically connected between the entrance plate and the exit plate. It also has an RF source capacitively coupled at a first phase to a first set of circumferential ring electrodes and capacitively coupled at a second phase to a second set of circumferential ring electrodes. The second phase is 180° out-of-phase from the first phase. The circumferential ring electrodes generate an RF field that substantially penetrates through the walls of the inner ceramic tube into the inner chamber. The inner ceramic tube is made of a first ceramic material that is characterized by a first room temperature electrical resistivity and by a first room temperature thermal conductivity. The outer ceramic tube is made of a second ceramic material that is characterized by a second room temperature electrical resistivity and a second room temperature thermal conductivity. The second room temperature electrical resistivity is higher than the first room temperature electrical resistivity by at least two orders of magnitude. In certain embodiments, the second room temperature thermal conductivity is higher than the first room temperature thermal conductivity by at least one order of magnitude.

Another embodiment is an ion optical element that has an outer ceramic tube made of a second ceramic material and an inner ceramic tube made of a first ceramic material. The inner ceramic tube is concentric to and within the outer ceramic tube, wherein the inner ceramic tube fits closely within the outer ceramic tube and is in thermal contact with the outer ceramic tube. There is an electric heater for heating the outer ceramic tube. This embodiment has a DC voltage power supply applying a DC voltage between an entrance end of the inner ceramic tube and an opposite end of the inner ceramic tube. The first ceramic material is characterized by a first room temperature electrical resistivity and by a first room temperature thermal conductivity. The first room temperature thermal conductivity is equal to at least about 30 W/m-K. The second ceramic material is characterized by a second room temperature electrical resistivity that is higher than the first room temperature electrical resistivity by at least two orders of magnitude.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

The disclosure herein of embodiments of an ion optical element should not be limited to the particular embodiments described herein. Instead, the disclosure may be applied to any ion optical element that may be used in a mass spectrometer or other instrument comprising certain of the features described herein and recited in the claims.

Figure 1A:
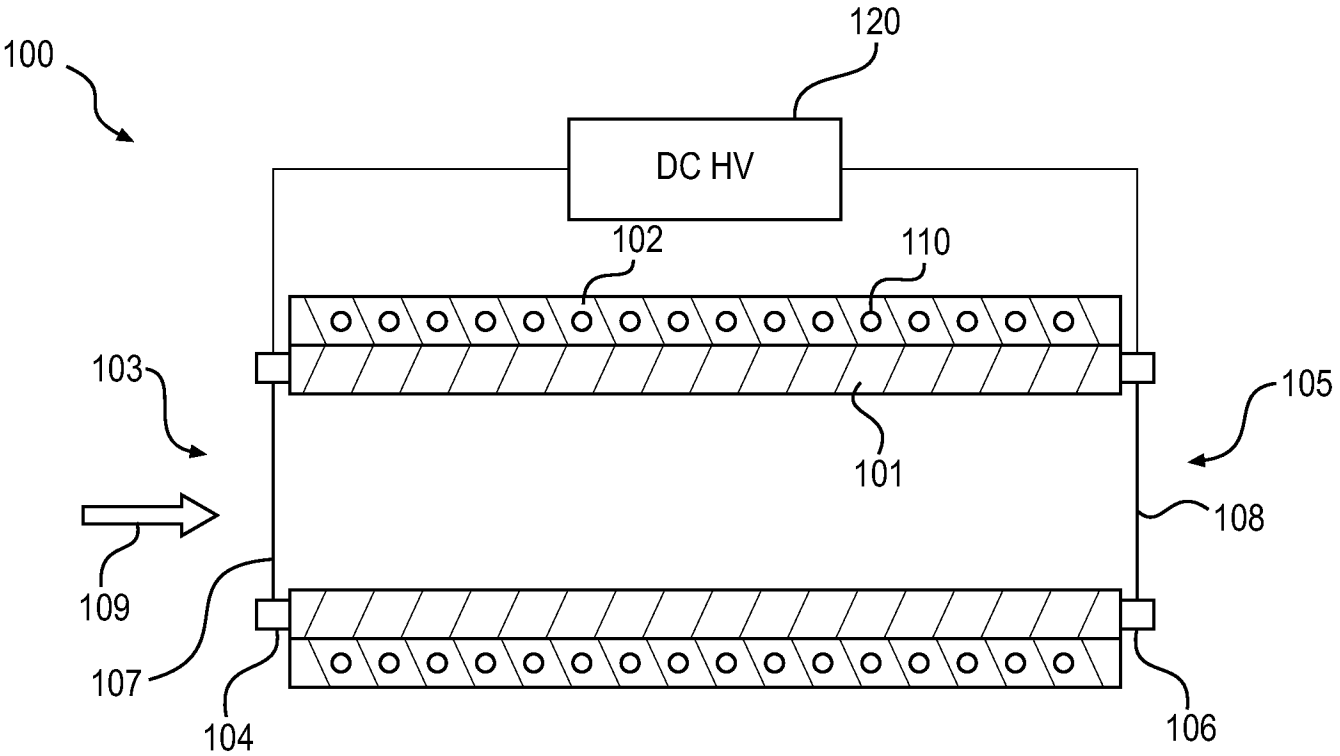
FIG. 1A is a schematic block diagram of an embodiment of an ion optical element with an embedded heater.

FIG. 1A is a schematic diagram of an embodiment of an ion optical element. As shown in FIG. 1A, the ion optical element 100 has an inner ceramic tube 101 within an outer ceramic tube 102. Inner ceramic tube 101 is in close thermal contact with outer ceramic tube 102. Outer ceramic tube 102 contains an embedded heater 110. Ion optical element 100 also has a high voltage DC power supply 120 connected at one polarity to the entrance end 103 of inner ceramic tube 101 via entrance ring electrode 104 and at the opposite polarity to the opposite end 105 of inner ceramic tube 101 via opposite end ring electrode 106. Entrance ring electrode 104 is also electrically connected to entrance conductive element 107. Opposite end ring electrode 106 is also electrically connected to opposite conductive element 108.

Conductive element 107 and conductive element 108 may be, for example, a screen or a grid (as in the examples shown in FIGS. 2A and 2B discussed below). They may also be a disk with an orifice in its center (as in the example shown in FIG. 2C discussed below). Conductive element 107 and conductive element 108 may alternatively be a disk or a plate with one orifice or with multiple orifices that allow ions to enter the ion optical element. Generally the orifices in the entrance conductive element may be substantially aligned with corresponding orifices in the exit conductive element. In some cases, a conductive element may be a disk or a plate with no orifices. Power supply 120 thus establishes an axial electric field within inner ceramic tube 101 via ring electrodes 104 and 106 and conductive elements 107 and 108.

Figure 1B:
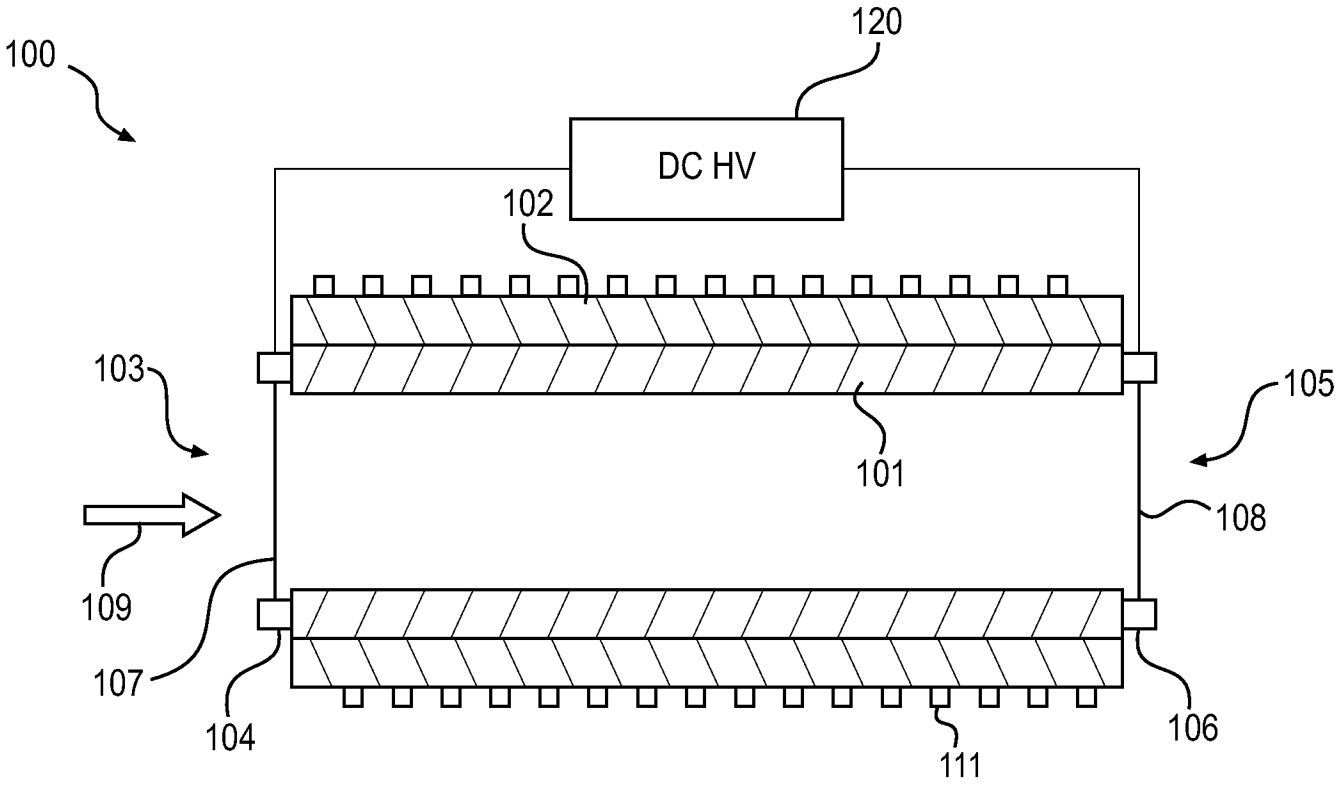
FIG. 1B is a schematic block diagram of an embodiment of an ion optical element with an external heater.

FIG. 1B is a schematic diagram of another embodiment of the ion optical element that is generally similar to the embodiment of FIG. 1A, but uses an electrical heater 111 that is external to the outer ceramic shell 102. The other components of the FIG. 1B embodiment are the same as the like-numbered components shown in FIG. 1A.

Figure 2A:
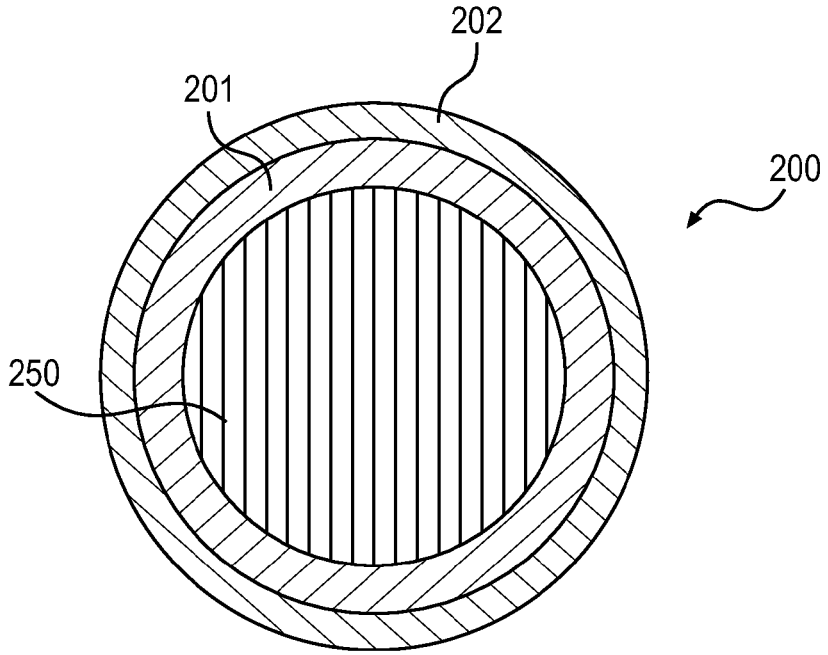
FIG. 2A is schematic diagram of an example of an entrance grid.
Figure 2B:
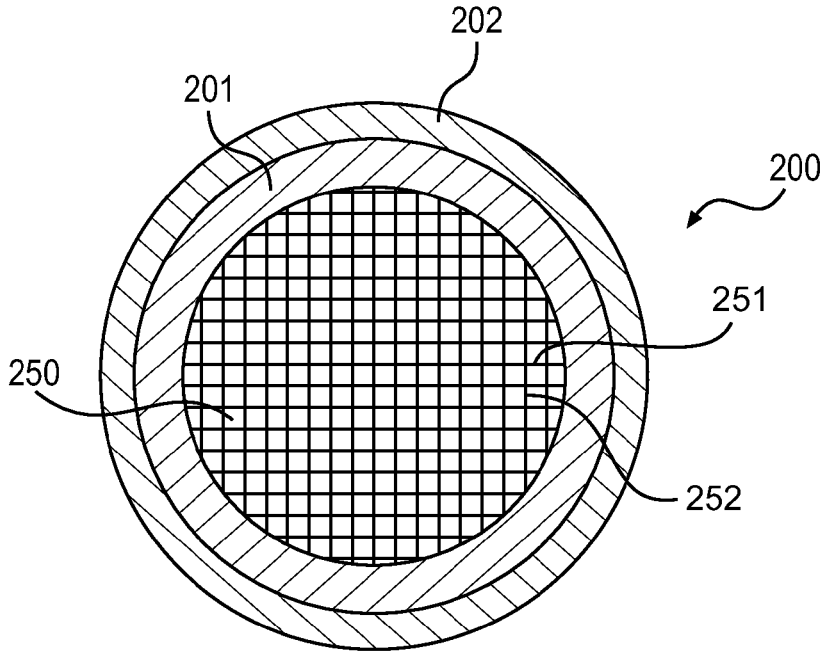
FIG. 2B is schematic diagram of another example of an entrance grid.
Figure 2C:
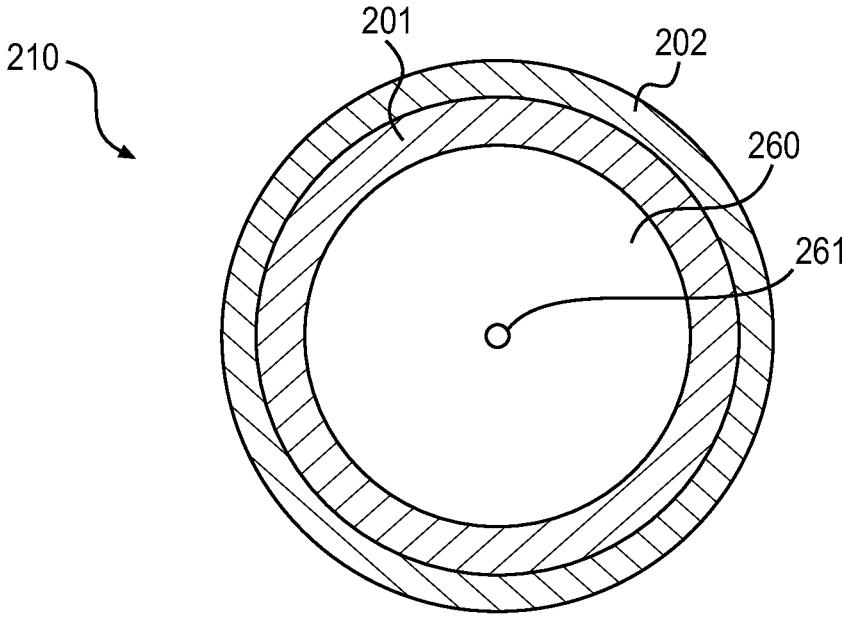
FIG. 2C is a schematic diagram of a conductive element that may be used at the entrance of an ion optical element.

FIGS. 2A, 2B and 2C are schematic diagrams of end views of three examples of conductive element 107 and/or conductive element 108. The schematic diagrams of end views of ion optical elements shown in FIGS. 2A, 2B and 2C show the end faces of inner ceramic tube 201 and outer ceramic tube 202, but do not show ring electrodes such as the ring electrodes 104 and 106 shown in FIG. 1A. These were omitted from FIGS. 2A, 2B and 2C for clarity. In the embodiment shown schematically in FIG. 2A, conductive element 250 is a grid of thin parallel metal wires that extend across the entrance and/or opposite end of ion optical element 200. In the embodiment shown in FIG. 2B, conductive element 250 is a grid with a first set of parallel wires 251 (shown horizontally in FIG. 2B) orthogonal to a second set of parallel wires 252 (shown vertically in FIG. 2B). In the embodiment shown in FIG. 2C, conductive element 260 is a metal disk with an orifice 261 in its center. Other conductive elements may be used as well, such as screens, or plates with one or more orifices, or disks with more than one orifice.

Inner ceramic tube 101 is made of a first ceramic material that has a high room temperature electrical resistivity and a high room temperature thermal conductivity. The first ceramic material has a resistivity that decreases as a function of increasing temperature over the temperature range of room temperature to 225° C. Zirconia is a good example of a material that could be used as the first ceramic material. Pure zirconia has a room temperature electrical resistivity that can range as high as $10^{12}$ Ω-cm. Yttria-blended zirconia and other zirconia blends, that have a room temperature electrical resistivity in the range of $10^{8}$ to $10^{12}$ Ω-cm, may also be used for the first ceramic material. Other ceramic materials or blends with these properties may also be used. The electrical resistivity of all of these materials decreases as a function of increasing temperature.

The reported room temperature thermal conductivity for various blends of zirconia range from 2 to 2.5 W/m-K. Certain Nickel-Zinc ferrites may also be suitable candidates. Examples are ferrite materials made by Fair-Rite Products Corporation of Wallkill, N.Y., such as their types 68, 67, 61, 52, 51, 44, 46, and 43 materials. Certain specialty glasses also possess suitable electrical properties although they may lack the desired mechanical and thermal properties. Examples are soda-lime and alumino-silicate glasses such as those made by Abrisa Technologies of Santa Paula, Calif. Fluorophlogopite based ceramics such as are sold by Ariake Materials Company, Tokyo, Japan could also be used. Silicon Carbide, while not as highly resistive ($10^{5}$ to $10^{8}$ Ω-cm) as zirconia, has higher thermal conductivity (60 to 200 W/m-K) and could also be used. The family of ESD-safe ceramics sold by Coorstek, Golden, Colo., at least one of which is based on alumina and many of which may have appropriate properties, may also be used.

In an embodiment, when the first ceramic material is a material with very high thermal conductivity, such as silicon carbide, the thermal conductivity of the outer ceramic tube need not be higher than the thermal conductivity of the inner ceramic tube. For example, with a silicon carbide tube that may have a thermal conductivity on the order of 30 W/m-K or higher, the second ceramic material would not be required to have a higher thermal conductivity than the first ceramic material, and may be even lower, for example it may be as low as 5 W/m-K or even 1 W/m-K. In this embodiment, the high thermal conductivity of the inner ceramic tube, together with a sufficient thermal conductivity in the outer ceramic tube is sufficient to ensure that the temperature of the inner ceramic tube is reasonably uniform. In all cases, however, the electrical resistivity of the second ceramic material should be two orders of magnitude or more higher than the electrical resistivity of the first ceramic material.

Outer ceramic tube 102 is made of a second ceramic material that has even higher room temperature electrical resistivity and even higher room temperature thermal conductivity than the first ceramic material. Specifically, the room temperature electrical resistivity of the second ceramic material should be higher than the room temperature electrical resistivity of the first ceramic material by two orders of magnitude or more. In embodiments in which the thermal conductivity of the first ceramic material is less than 5 W/m-K at room temperature, the thermal conductivity of the second ceramic material should be higher than the thermal conductivity of the first ceramic material by about an order of magnitude or more. The electrical resistivity of the second ceramic material should be higher than the electrical resistivity of the first ceramic material by at least two orders of magnitude from room temperature up to a temperature of 225° C. In embodiments in which the thermal conductivity of the first ceramic material is less than 5 W/m-K at room temperature, the thermal conductivity of the second ceramic material should be higher than the thermal conductivity of the first ceramic material by at least an order of magnitude from room temperature up to a temperature of 225° C.

Aluminum nitride is a good example of a material that could be used as the second ceramic material. Aluminum nitride has an electrical resistivity that can range from $10^{12}$ to $10^{15}$ Ω-cm and a thermal conductivity that can range above 70 W/m-K. As another example, Shapal Hi-M soft may be used as the second ceramic material. It is a composite sintered body of aluminum nitride and boron nitride, has a reported electrical resistivity of $10^{15}$ Ω-cm, and a reported thermal conductivity of 92 W/m-K. Shapal Hi-M soft is available from Goodfellow USA (Coraopolis, Pa.) or Precision Ceramics US (Tampa, Fla.). Sapphire, which may have a thermal conductivity of about 25-35 W/m-K and an electrical resistivity above $10^{15}$ Ω-cm, is another material that may be used as the second ceramic material. Silicon nitride, which may have a thermal conductivity of about 30 W/m-K and an electrical resistivity above $10^{14}$ Ω-cm, is another material that may be used as the second ceramic material.

Before ion optical element 100 can be used, power is applied to embedded heater 110 (shown schematically in FIG. 1A) or to external heater 111 (shown schematically in FIG. 1B) to heat outer ceramic tube 102 to a uniform temperature above room temperature such as 50° C. to 225° C. This temperature will be referred to herein as the "elevated temperature." Outer ceramic tube 102 will have an essentially uniform temperature along its length and around its circumference because it is made of a material that has very high thermal conductivity. Also, because inner ceramic tube 101 is also made of a material that has a high thermal conductivity, and because it is in intimate contact with outer ceramic tube 102, inner ceramic tube 101 will also be held at an essentially uniform temperature that will be very close to or equal to the temperature of the outer ceramic tube.

At the elevated temperature, the resistivity of the inner ceramic tube is lower than it was at room temperature. For example, the elevated temperature and the device geometry may be selected such that the overall resistance of the inner ceramic tube is between 50 Meg-ohms and 1000 Meg-ohms when the high voltage DC potential applied across the length of the inner ceramic tube 101 is 1-5 kV. This results in a uniform voltage drop along the length of the inner ceramic tube. This voltage drop produces a current through the walls of the inner ceramic tube of $10^{-9}$ amps to $10^{-4}$ amps and a substantially uniform electric field within inner ceramic tube 101. This electric field is substantially aligned with the axis of the inner ceramic tube. In embodiments used as collision cells, reaction cells or ion guides as described below, where the applied voltage is typically in the range of 10-150 volts, the resistance can be comparably lower. As a general rule, it is desirable to keep the current flow below $10^{-4}$ amps.

In operation, ions enter ion optical element 100 at entrance 103 travelling in the direction indicated by arrow 109. They pass through conductive element 107. Conductive element 107 may be a grid as shown in FIG. 2A or FIG. 2B, or a disk with an orifice in its center as in FIG. 2C, which are described below. The ions then pass through inner ceramic tube 101 under the influence of the electric field within inner tube 101. The homogeneity and uniformity and direction of that electric field are dependent upon the configuration and characteristics of inner ceramic tube 101, conductive element 107 and conductive element 108.

Depending upon the direction of the electric field, the polarity of the ions and the direction the ions are travelling as they enter the ion optical element, the electric field can either promote or oppose the motion of the ions within the ion optical element, or both. For example, when the ion optical element is used as a reflectron in a TOF mass spectrometer, the axial electric field opposes the motion of the ions as they enter the ion optical element until the ions reverse direction, as described below. After the ions reverse direction, the axial electric field drives the ions back towards the entrance of the reflectron. In an ion mobility spectrometer and in a collision or reaction cell, the axial electric field is used to drive the ions through the ion optical element.

Figure 3:
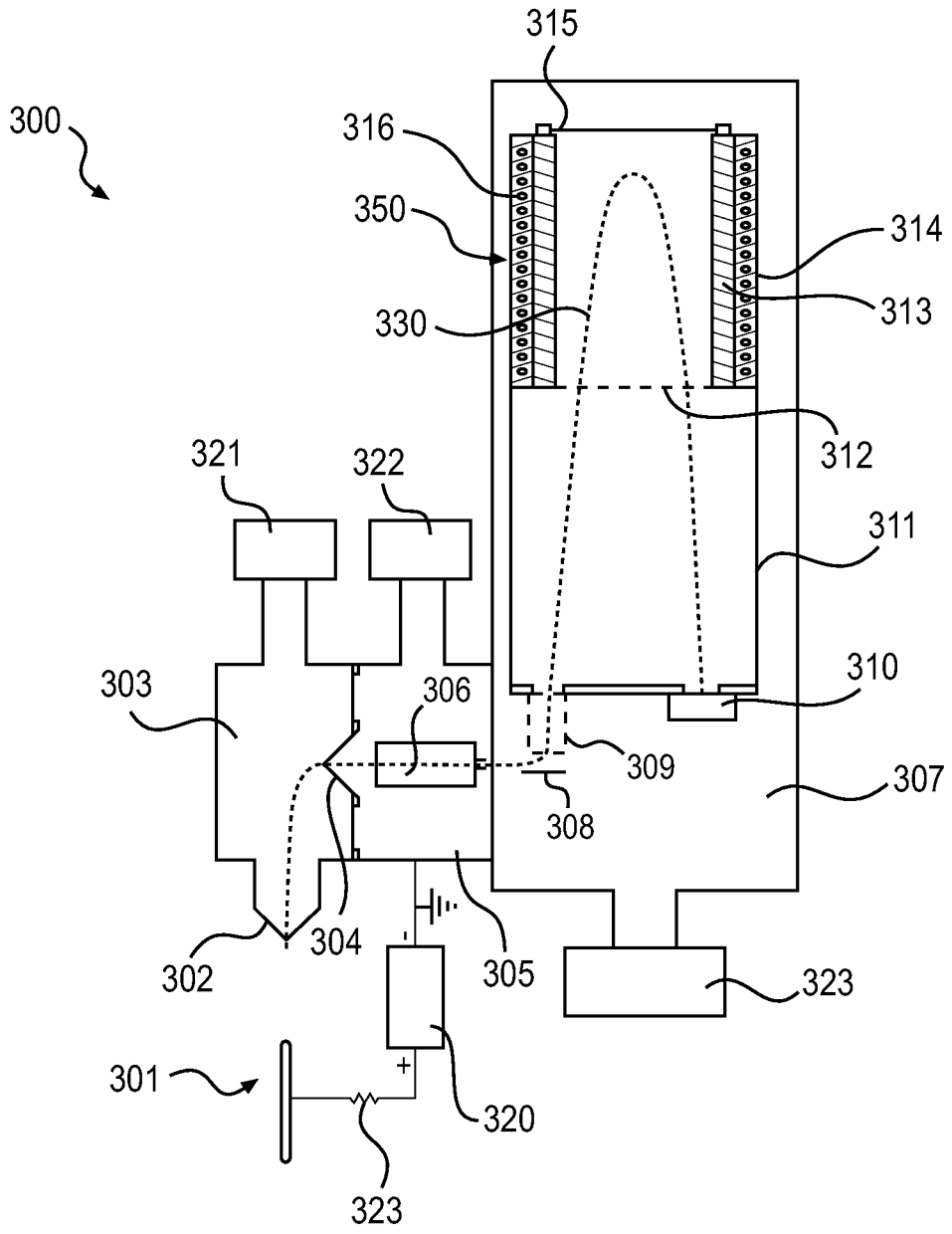
FIG. 3 is a schematic diagram of an ion optical element used as a reflectron in a time-of-flight mass spectrometer.

FIG. 3 is a schematic diagram showing an ion optical element used as a reflectron 350 in a time-of-flight mass spectrometer 300. Ions generated from a source of charged particles 301 enter mass spectrometer 300 via entrance cone 302. They are then directed by electric fields and gas flow within chamber 303 through skimmer 304, through ion guide 306 in chamber 305 and into chamber 307. In chamber 307, pusher plate 308 and the nearest electrode in stack of ring electrodes 309 are typically at the same electrical potential. The space between pusher plate 308 and the nearest ring electrode fills with ions from ion guide 306. Pusher plate 308 is then rapidly pulsed to a higher voltage with respect to the nearest ring electrode. In the case of positive ions, it may typically be pulsed 500 volts more positive than the nearest ring electrode in the stack of ring electrodes 309. This creates a temporary electric field between the pusher plate and the nearest ring electrode in stack 309 which is orthogonal to the initial direction the ions are travelling in. This orthogonal electric field drives the ions into flight tube 311.

Power supply 320 applies a high voltage to source 301, such that charged particles emitted by the source are attracted to front cone 302, which is at or near ground. Current-limiting resistor 323 may be used between power supply 320 and source 301. Vacuum pumps 321, 322 and 323 evacuate chambers 303, 305 and 307, respectively. The pressure in chamber 307, for example, needs to be maintained at a very low pressure, for example at $10^{-6}$ Torr or less.

The ions then travel through flight tube 311, pass through entrance grid 312 and enter reflectron 350. Because the initial velocity of the ions as they enter flight tube 311 is determined by their mass-to-charge ratio m/z as they are accelerated by the orthogonal electric field, the ions separate according to their m/z ratios as they travel through flight tube 311. The ions then enter reflectron 350, where they face an electric field between end plate 315 and entrance grid 312 opposing their motion. Reflectron tube 350 is described in greater detail below with reference to FIGS. 4 and 5. The reflectron tube shown in FIG. 3 has an inner ceramic tube 313, an outer ceramic tube 314 with an embedded heater 316, an entrance grid 312 and an end plate 315.

As shown by trajectory 330 in FIG. 3, the forward motion of the ions is eventually reversed, and the ions are directed back to ion detector 310. Ion detector 310 may be a dual microchannel plate detector or it may be a fast secondary emission multiplier or it may be another appropriate type of detector. Detector 310 produces a fast voltage pulse every time it is impacted by an ion. This voltage pulse typically passes through a decoupling capacitor to an external amplifier and signal processing electronics, and eventually to a computer for storage, further processing and display.

Figure 4:
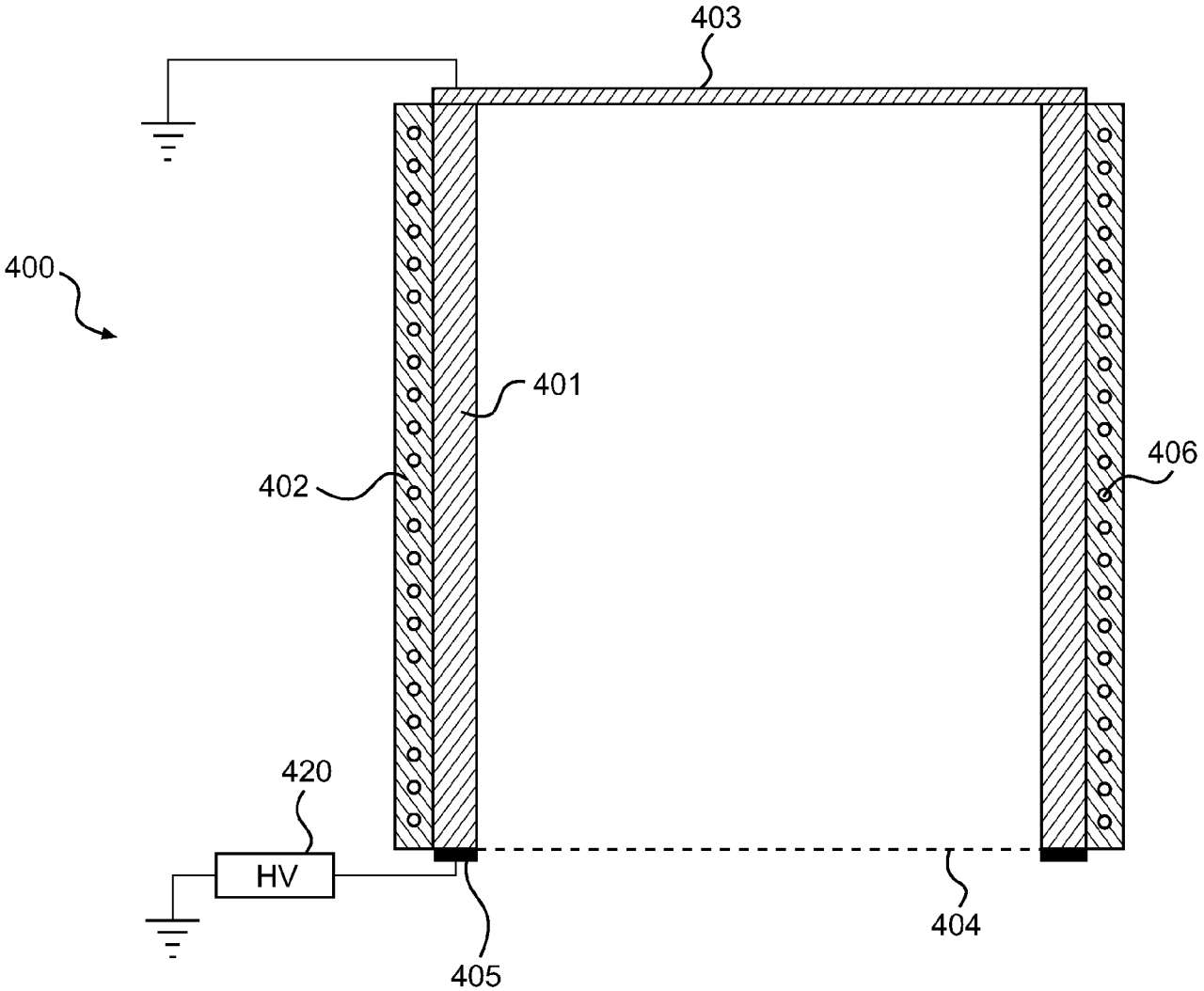
FIG. 4 is a schematic diagram of an embodiment of an ion optical element that may be used as a reflectron in a time-of-flight mass spectrometer.

An embodiment of a reflectron is shown in more detail in FIG. 4. As shown in FIG. 4, reflectron 400 has an end plate 403 capping an inner ceramic tube 401 which in turn fits within an outer ceramic tube 402. Heater 406 is embedded in outer ceramic tube 402. End plate 403 may be a metallic conductor, such as stainless steel. It is held at ground. Entrance grid 404 is mounted on grid mounting ring electrode 405. Grid mounting ring electrode 405 may be made from a metallic conductor such as stainless steel. Grid mounting ring 405 and grid 404 are held at a high voltage by power supply 420. The polarity of the voltage applied to grid mounting ring 405 and entrance grid 404 is selected to repel the ions after they pass through entrance grid 404 and into the space in reflectron 400 between entrance grid 404 and end plate 403. For example, high voltage power supply 420 could apply a negative voltage of several kilovolts, for example, about −5 kV, to grid mounting ring electrode 405 if positive ions are being detected, and it would apply a positive voltage of similar magnitude if negative ions are being detected.

Because inner ceramic tube 401 is resistive at the elevated temperature, rather than being an insulator, any charge that lands on the interior surface of inner ceramic tube 401 is dissipated. This prevents the buildup of a space charge that would otherwise introduce irregularities in the electric field within inner ceramic tube 401. Furthermore, because inner ceramic tube 401 is resistive at elevated temperature, the application of an electrical potential by high voltage power supply 420 produces a uniform potential gradient along its length. This uniform potential gradient along the length of inner ceramic tube 401, in conjunction with grid 404 and end plate 403, produces a uniform electric field inside reflectron 400.

Figure 5:
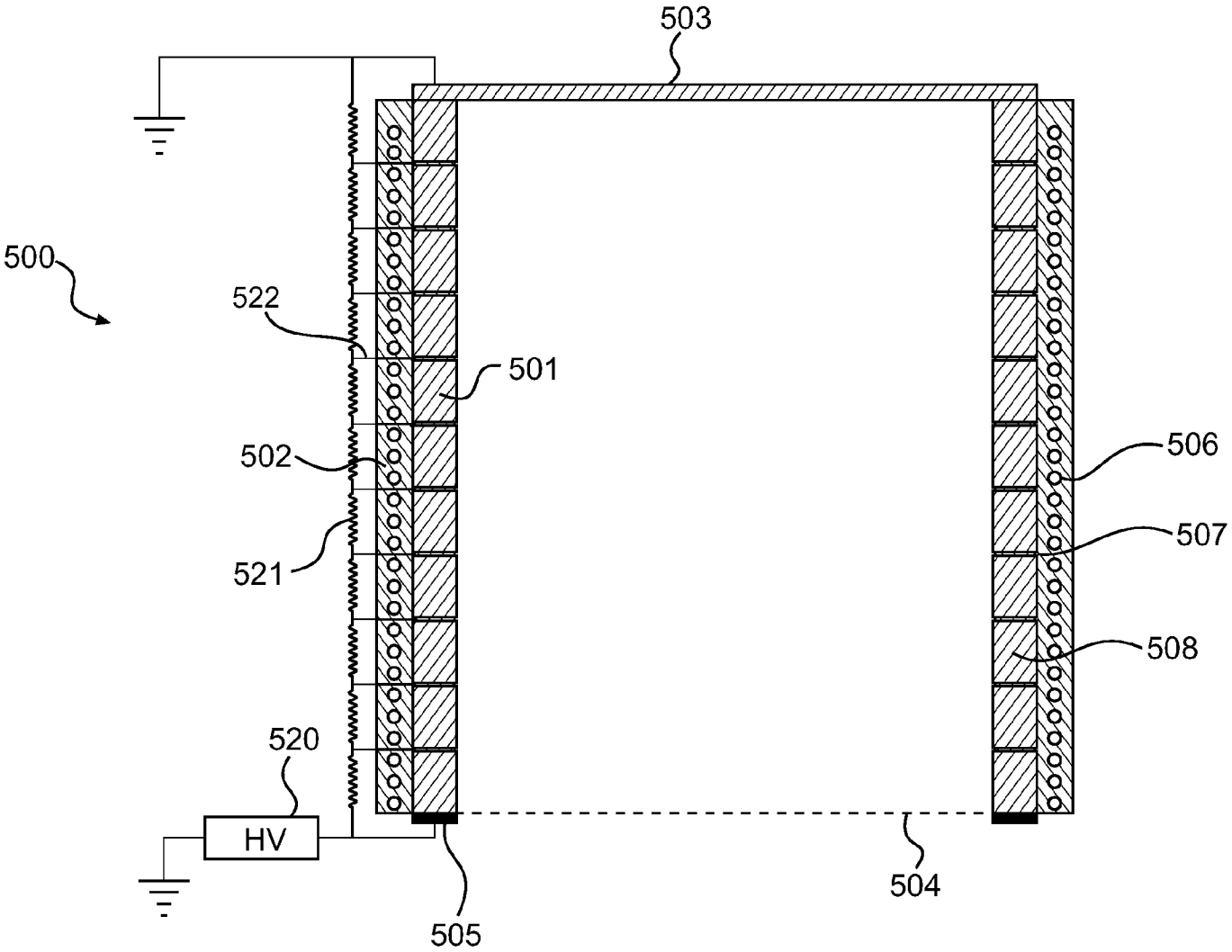
FIG. 5 is a schematic diagram of another embodiment of an ion optical element that may be used as a reflectron in a time-of-flight mass spectrometer.

Another embodiment of a reflectron is shown in FIG. 5. In this embodiment, reflectron 500 has an end plate 503 capping an inner tube 501 made up of alternating metal ring electrodes 507 and ceramic rings 508. Metal ring electrodes 507 are typically 0.02 to 1.0 mm thick and ceramic rings 508 are typically 1.0 to 4.0 mm thick. Metal ring electrodes 507 may also have a slightly smaller inner diameter than ceramic rings 508. The reflectron would typically have at least five sets of metal ring electrodes and ceramic washers. Inner tube 501 fits within an outer ceramic tube 502, which has an embedded heater 506. Inner tube 501 has a grid mounting ring electrode 505 bonded around its entrance end. End plate 503 may be a metallic conductor, such as stainless steel. It is held at ground. Entrance grid 504 is mounted on grid mounting electrode 505. Entrance grid 504 and grid mounting electrode 505 are held at a high voltage by power supply 520. The polarity of the voltage applied to grid mounting ring 505 and entrance grid 504 is selected to repel the ions after they pass through entrance grid 504 and into the space in reflectron 500 between entrance grid 504 and end plate 503. For example, high voltage power supply 520 would apply a negative voltage of, e.g., −5 kV to entrance end ring electrode 505 if positive ions are being detected, and it would apply a negative voltage of similar magnitude if negative ions are being detected.

In addition, this embodiment has a resistor network 521 electrically connected via electrical connections 522 to the metal ring electrodes 507 that, together with ceramic rings 508, form inner tube 501. All of the resistors in resistor network 521 have the same value. As shown, they distribute the voltage from high voltage DC power supply 520 to metal ring electrodes in incremental steps cascading down (or up) from the maximum voltage at entrance end ring electrode 505 which may be, for example, at 2 kV or 5 kV or at another voltage within that range, down (or up) to ground at end plate 503.

Ceramic rings 508 are resistive rather than being insulators at the elevated temperature, and metal ring electrodes 507 are conductive. Thus any charge that lands on the interior surface of inner ceramic tube 501 dissipates. This prevents any buildup of a space charge on the interior surface of inner ceramic tube 501.

Entrance grid 404 in FIG. 4 and entrance grid 504 in FIG. 5 may have one set of equidistant fine parallel wires as in the example shown in FIG. 2A, or may have two orthogonal crossed sets of parallel wires as in the example shown in FIG. 2B. In the FIG. 5 embodiments, the wires are stretched taught and supported by mounting ring electrode 505.

The use of a first ceramic material such as stabilized zirconia in combination with a second ceramic material such as aluminum nitride in the construction of the embodiments shown in FIGS. 1-5 above has many advantages. Zirconia, for example, is readily machined to high mechanical tolerance and is much stronger than glass. Aluminum nitride, for example, can be used in contact with the zirconia to control the temperature of the zirconia without affecting the electrical fields generated by the zirconia elements. It remains a good electrical insulator at temperatures at which zirconia becomes resistive. The aluminum nitride can be heated by an embedded heater, such as heater 110 shown in FIG. 1A, or by an external heater such as heater 111 shown in FIG. 1B.

While mechanically more elaborate, the structures of the embodiment shown in FIG. 5 may reduce any electric field inhomogeneities that may result from variations in zirconia tube wall thickness or composition. Also, because of the mechanical strengths of ceramics, it is also optionally possible to use the ceramic tube of the embodiment of FIG. 5 as the wall of the vacuum system of the mass spectrometer, rather than having the reflectron enclosed in a vacuum system, as shown in the example of FIG. 1A.

Dual stage reflectrons that have two grids defining two stages of constant ion-repelling electric fields and gridless reflectors can similarly benefit from the two concentric cylinder construction described above. Also, the pusher region ring stack could also be implemented using the two concentric cylinder construction.

Embodiments of the ion optical element may also be used as an ion mobility drift tube in ion mobility spectrometers. In an ion mobility spectrometer, ions to be analyzed are driven by static electric fields towards the entrance grid of the ion mobility drift tube. The ion drift tube is filled with a neutral background gas, which may be at atmospheric pressure or at another pressure such that analyte ions are constantly losing kinetic energy through collisions with the background gas. Because the mobility of an analyte ion through the background gas is a function of its size and shape, different analyte ions may reach the detector portion of the ion mobility spectrometer after different transit times through the ion mobility drift tube. These different transit times may be used to characterize and/or identify the analyte ions.

Figure 6:
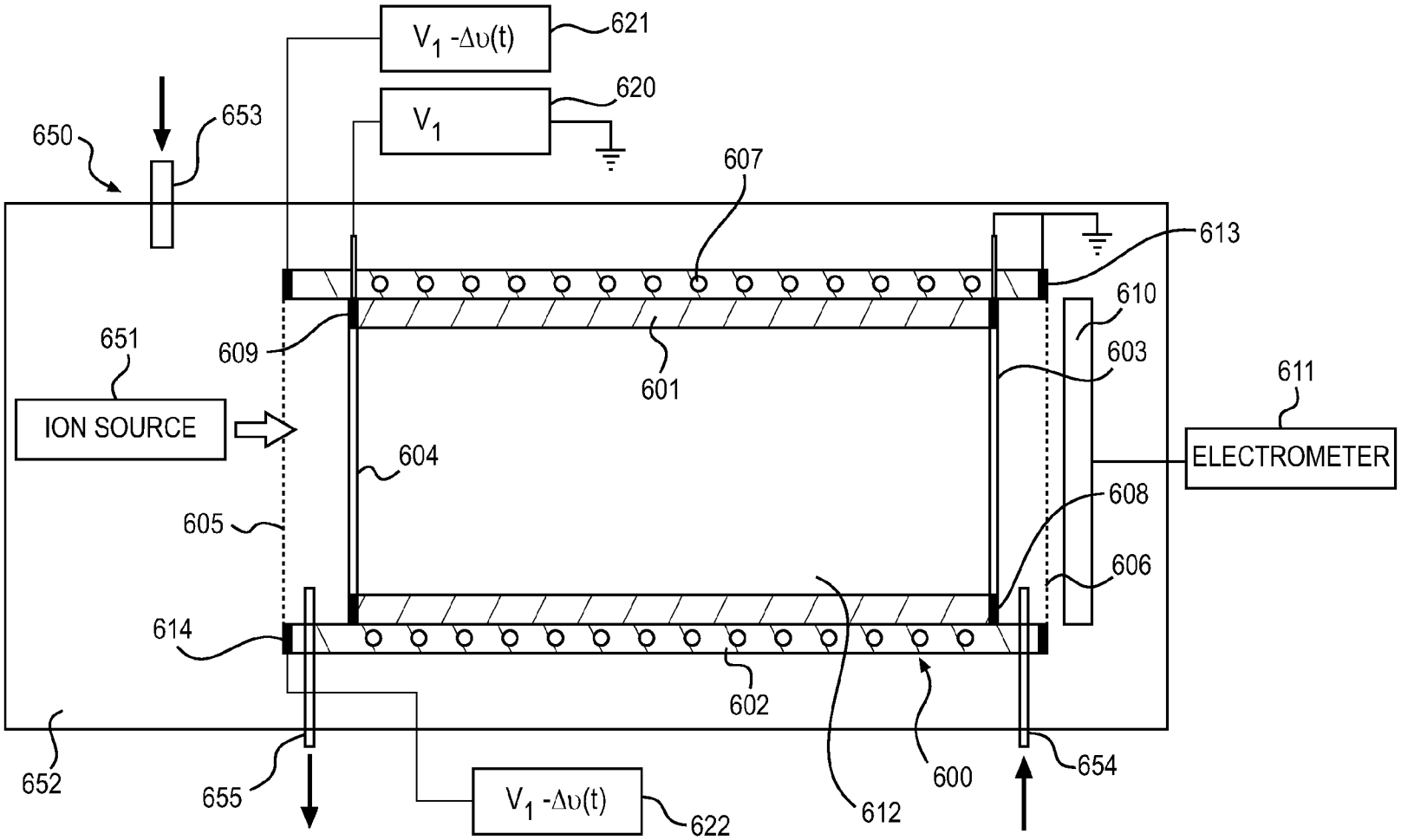
FIG. 6 is a schematic diagram of an embodiment of an ion optical element that may be used in an ion mobility spectrometer.

An example of an ion mobility drift tube that may be used in an ion mobility spectrometer is shown schematically in FIG. 6. Ion mobility spectrometer 650 has an ion source 651 in chamber 652 that generates ions that enter chamber 612 in ion mobility drift tube 600 through entrance grid 605. Ion mobility drift tube 600 has an inner ceramic tube 601 made of the first ceramic material and an outer ceramic tube 602 made of the second ceramic material. Outer ceramic tube 602 includes an embedded electric heater 607. It has an entrance grid 605 on the end of the ion mobility drift tube closest to the ion source, and exit grid 606 at the opposite side. Entrance grid 605 is mounted on grid mount 614 on the entrance end of outer ceramic tube 602. An example of an entrance grid is shown and described in more detail with reference to FIG. 7 below. Exit grid 606 is mounted on grid mount 613 at the exit end of outer ceramic tube 602. Ion mobility drift tube 600 also has an entrance connector ring 604 at the entrance side of the ion mobility drift tube and an exit connector ring 603 at the exit side of the drift tube.

As the ions travel through chamber 652 and enter chamber 612, they may be mixed with a neutral background gas introduced, for example, via port 653. The ions are directed towards entrance grid 605 of ion mobility drift tube 600 by a static electric field between ion source 651 and entrance grid 605. Power supply 620 produces a voltage $V_1$ between the entrance connector ring 604 and the exit connector ring 603. Typically, $V_1$ is on the order of several kV; for example it may be about 3 kV when chamber 312 has a length of about 10 cm. An electric field established by voltage $V_1$ drives the ions towards the exit end of ion mobility drift tube 600. Connector rings 603 and 604 ensure that the voltage from power supply 620 is applied evenly around the inner ceramic tube, such that the current flow through the walls of inner ceramic tube 601 is uniformly distributed around the circumference of inner ceramic tube 601.

Entrance grid 605 may be controlled by voltage sources 621 and 622 to act as a shutter, as explained below. This allows ions to be admitted into ion mobility drift tube 600 at precise times, so that the spectrometer can measure the drift times of the ions within ion mobility tube 600. This construction is explained below with reference to FIG. 7.

As the ions drift through chamber 612, they are subject to a counterflow of clean gas that is introduced into chamber 612 via port 654 and that exits via exhaust port 655. This counterflow of clean gas damps the forward motion of the ions, to an extent that is dependent on the mobility of the ions in the counterflow gas. Since different species may have different ion mobilities, the ions of different species separate as they drift through ion mobility drift tube 600 and arrive at collector 610 at different times relative to when entrance grid 605 was opened. The arrival of ions at collector 610 is detected as an electric current which is measured by electrometer 611.

In operation, outer ceramic tube 602 and its embedded heater 607 raise the temperature of inner ceramic tube 601. When inner ceramic tube 601 reaches a temperature at which it becomes sufficiently conductive, the electric potential imposed across it results in a stable current through the walls of inner ceramic tube 601. Since the wall thickness of inner ceramic tube 601 is uniform, this produces a uniform voltage drop along the length of the inner ceramic tube 601. This uniform voltage drop produces a constant electric field inside inner ceramic tube 601. Exit grid 606 serves to eliminate any end effects that would generate field non-uniformities. Entry grid 605 may be pulsed open for a short time, typically 1 ms or less, and the ions admitted then travel down inner ceramic tube 601 and pass out through exit grid 606. They can then be detected and measured by collector plate 610 and electrometer 611, as described above.

Figure 7:
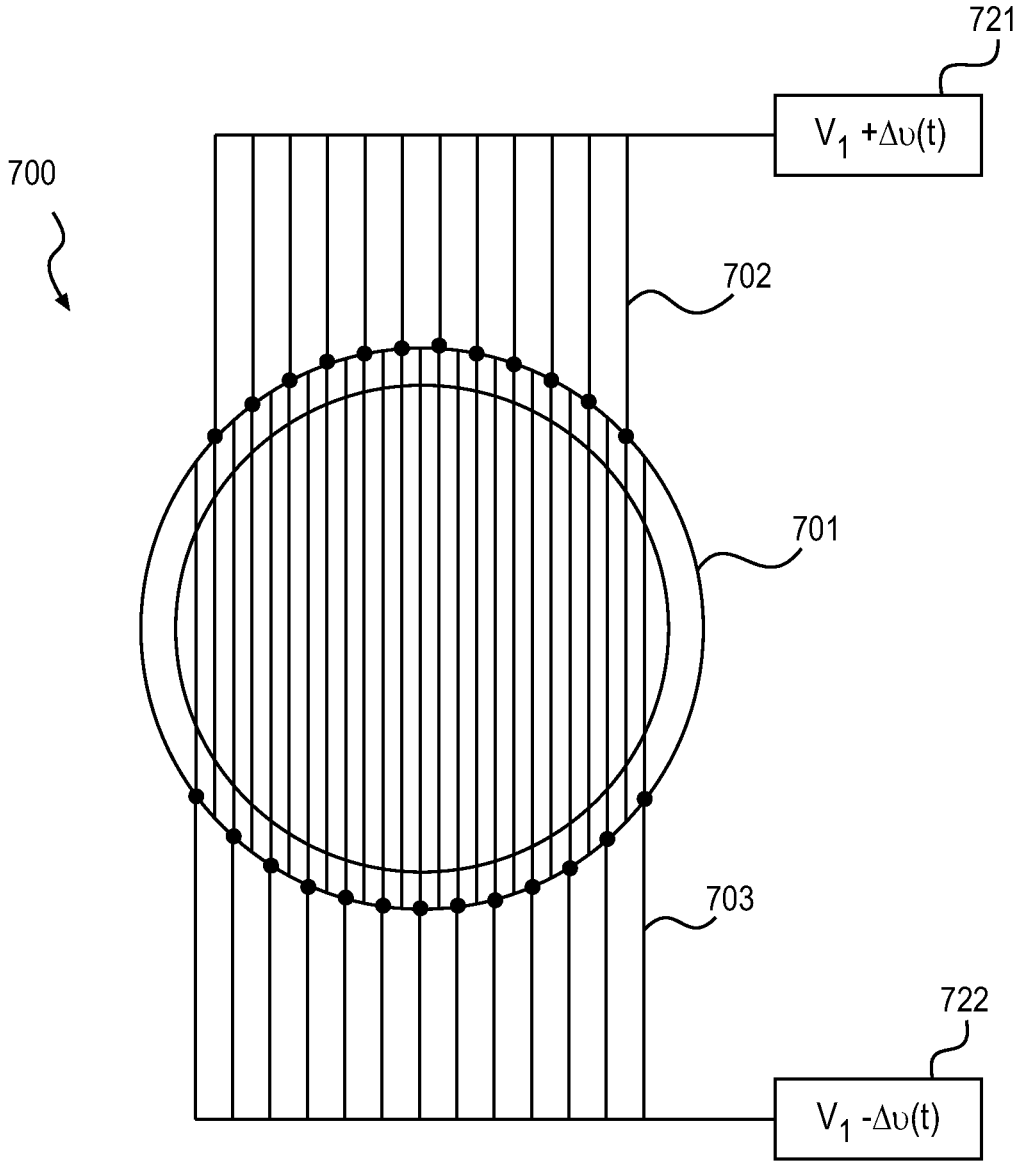
FIG. 7 is a schematic diagram of an entrance grid that may be used in the ion optical element of FIG. 6.

A common design for an entrance grid is a Bradbury-Nielson shutter grid. As shown in FIG. 7, this shutter grid 700 consists of thin parallel wires mounted on an insulating ring 701. Shutter grid 700 has a first set of parallel wires 702 and a second set of parallel wires 703. The parallel wires in the two sets extend in the same direction, and are interleaved, as shown in FIG. 7. When the same electrical potential is applied to both set of parallel wires 702 and set of parallel wires 703, shutter grid 700 is open, i.e., it will let ions pass through. Shutter grid 700 is closed by applying an additional potential to the open potential. For the first set of parallel wires 702, the additional potential is additive to the open potential; for the second set of parallel wires 703, it is subtractive to the open potential. In that case, instead of passing through the grid, the ions are attracted to the wires and do not pass through the grid.

In the embodiment shown in FIG. 6, the entrance end of the inner ceramic tube is coated with thin metal film 609 and the exit end of the inner ceramic tube is coated with a thin metal film 608. These metal films ensure that there is a uniform connection between the entrance and exit grids and the ends of the inner ceramic tube.

In a different embodiment, it may be advantageous to vary the electric field inside the inner ceramic tube by varying its wall thickness. This will produce a non-uniform voltage drop along the tube length which in turn will produce a non-uniform electric field.

Figure 8A:
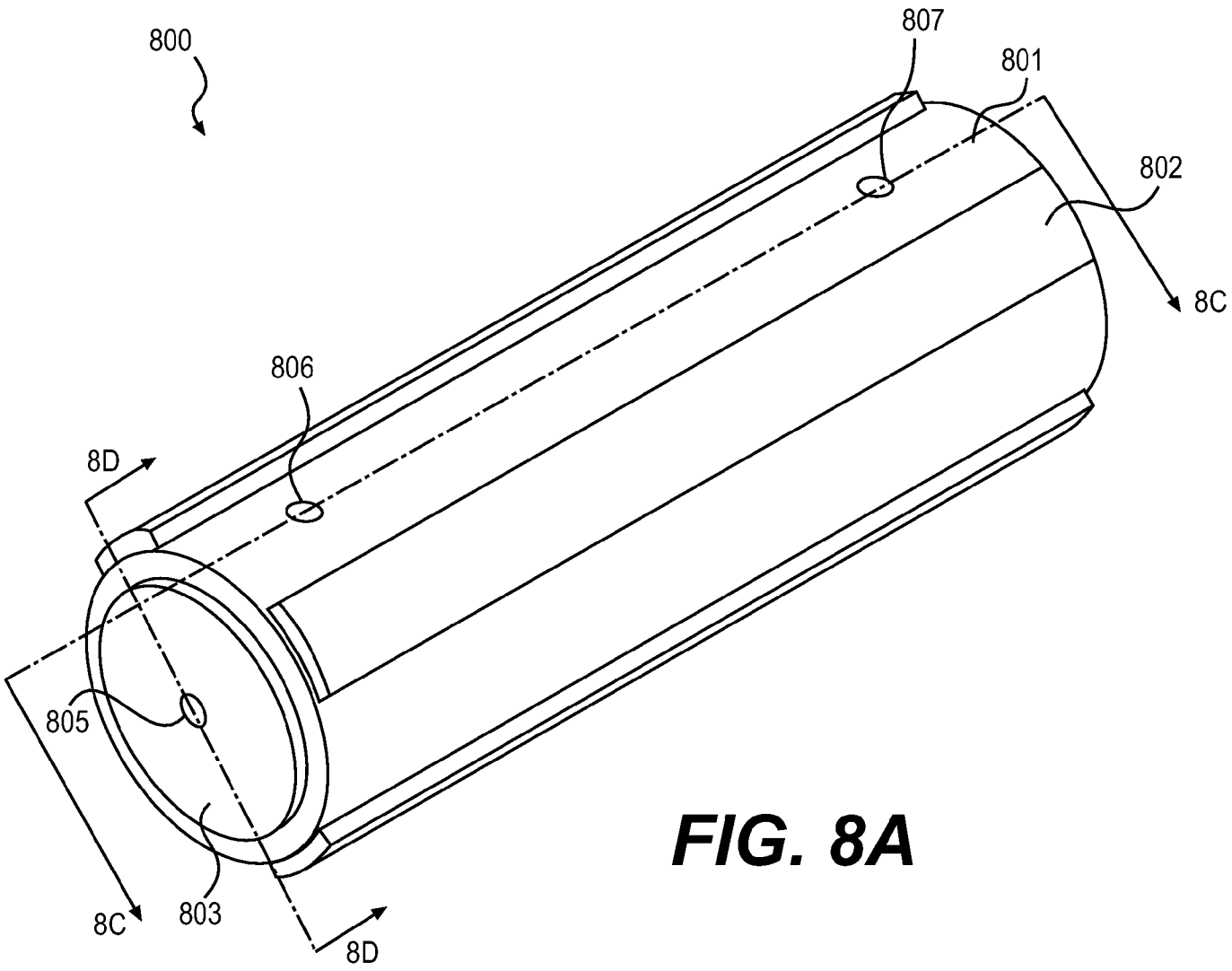
FIG. 8A is a schematic diagram of a perspective view of an embodiment of an ion optical element that may be used as an ion guide, a collision cell or a reaction cell.

FIG. 8A is a schematic diagram of an ion optical element 800 that can be used with an RF field as an ion guide, a collision cell or a reaction cell in a mass spectrometer. When it is used as an ion guide, it would typically be operated in an intermediate vacuum stage, and would guide the ions as they travel through that stage of the mass spectrometer. When used as a collision cell, the interior of the ion optical element is filled with a neutral non-reactive collision gas, such as He, $N_2$ or Ar gas, at a pressure selected such that ions traveling through the ion optical element 800 fragment when they collide with the molecules of the neutral collision gas. When used as a reaction cell, the interior of the ion optical element is filled with a gas such as ammonia, methane, oxygen or hydrogen, which reacts differently with different ions to produce reaction products that reduce or eliminate isobaric interferences. With known modifications, it can also be used for reactions such as electron capture dissociation or electron transfer dissociation.

Ion optical element 800 has an inner ceramic tube made of the first ceramic material (not visible in FIG. 8A) within an outer ceramic tube 801 made of the second ceramic material. Ion optical element 800 has an entrance plate 803 with an orifice 805 at its center. Entrance plate 803 may be made of an electrically conductive material such as stainless steel. A similar plate is mounted at the exit end of the ion optical element. Electrodes 802 may be used to apply an RF signal to the ion optical element 800, as described below with reference to FIG. 8B. If the ion optical element is used as a collision or reaction cell, port 806 may be used to introduce the collision or reaction gas into the inner ceramic tube. Port 807 may be connected to a pressure gauge that could be used to measure the pressure inside the inner ceramic tube.

Figure 8B:
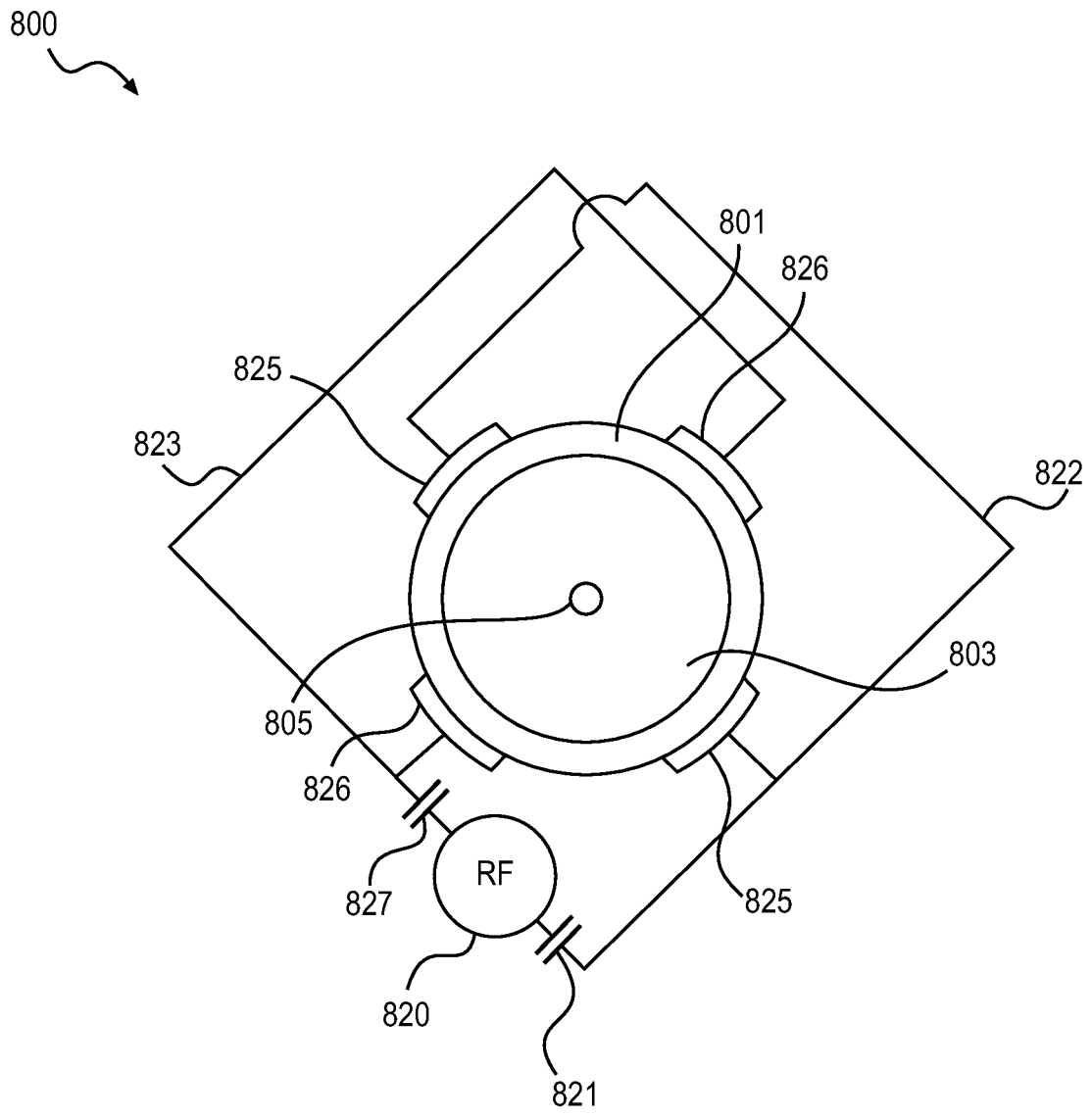
FIG. 8B is a schematic diagram of an end view of the embodiment of FIG. 8A.

FIG. 8B is an end view of ion optical element 800. It shows an RF source 820 applying a radio frequency signal to electrodes 825 and 826 mounted on the outer ceramic tube. One polarity of RF source 820 is applied via capacitor 821 and electrical connection 822 to a first pair of opposing electrodes 825 and the opposite polarity is applied via capacitor 827 and electrical connection 823 to a second pair of opposing electrodes 826. The fields produced by the RF signal at electrodes 825 and 826 serve to confine the ions radially.

Figure 8C:
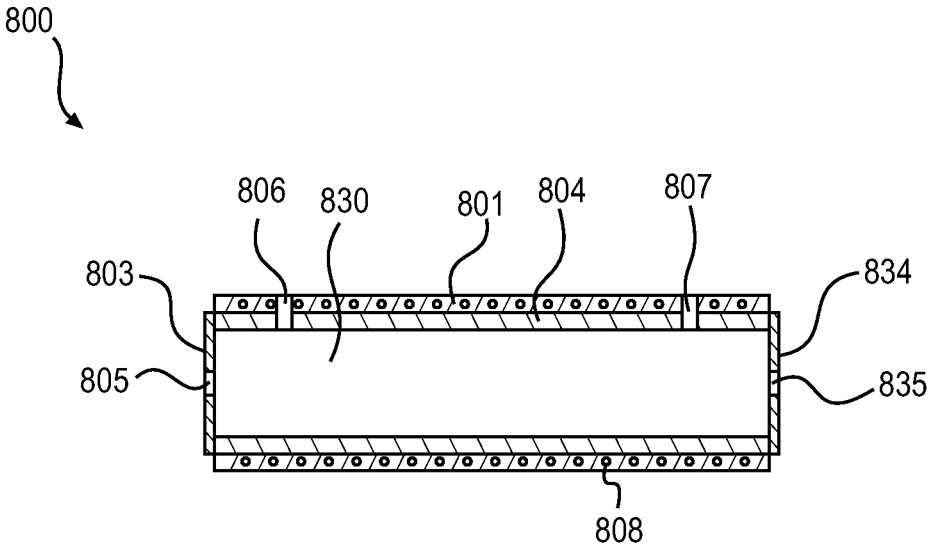
FIGS. 8C and 8D are a schematic diagrams of cross-sectional views of the embodiment of FIG. 8A.
Figure 8D:
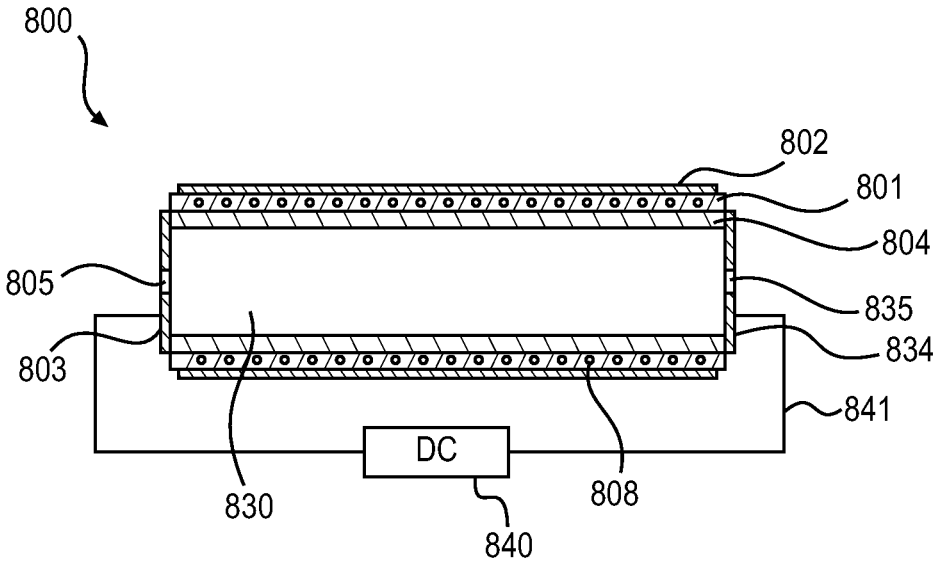

FIG. 8C is a schematic diagram of a cross-section of ion optical element 800 taken at 8C-8C in FIG. 8A. FIG. 8D is a schematic diagram of a cross-section of ion optical element 800 taken at 8D-8D in FIG. 8A. As shown in FIGS. 8C and 8D, outer ceramic tube 801 has an embedded electrical heater 808. FIGS. 8C and 8D also show inner ceramic tube 804 within outer ceramic tube 801. A DC power supply 840 applies a DC voltage across the length of inner ceramic tube 804 from entrance disk 803 to exit disk 834 via electrical connections 841. Entrance disk 803 and exit disk 834 are made from a conductive material such as stainless steel. Typically, DC power supply 840 applies about 50-150 volts to electrical connections 841.

Ions from earlier stages of the mass spectrometer enter ion optical element 800 via hole 805 in entrance plate 803, and travel through the interior chamber 830 of inner ceramic tube 804. If ion optical element 800 is used as a collision cell, fragments of those ions exit chamber 830 through hole 835 in exit plate 834. If ion optical element 800 is used as a reaction cell, any reaction products exit chamber 830 through hole 835 in exit plate 834. The collision or reaction gas is introduced into interior chamber 830 via port 806. If ion optical element 800 is used as an ion guide, it does not need to have port 806 or port 807, because no collision gas or reaction gas is introduced into chamber 830.

Embedded heater 808 is used to raise the temperature of the inner ceramic tube to a temperature at which the resistivity of the inner ceramic tube is such that (1) a current flows along the length of inner ceramic tube 804 and (2) the RF field substantially penetrates through the ceramic tubes into chamber 830. This effect is described in U.S. Pat. Nos. 3,937,954 and 4,013,887, which are incorporated by reference herein in their entirety.

For yttria-stabilized zirconia with about an 8% yttria component, a typical operating temperature could be in the range of 100° C. to 150° C. for RF frequencies of 0.5 MHz to 3 MHz.

DC power supply 840 is used to establish an axial DC field that keeps the ions moving through chamber 830, as shown in FIG. 8D. In some cases, the inner ceramic tube may also be part of the wall of the mass spectrometer's vacuum system. The RF field is imposed by using electrodes 802 (identified in FIG. 8B as electrode pair 825 and electrode pair 826), as in a conventional RF-only quadrupole collision cell, such as the collision cell described in U.S. Pat. No. 5,847,386.

Figure 9A:
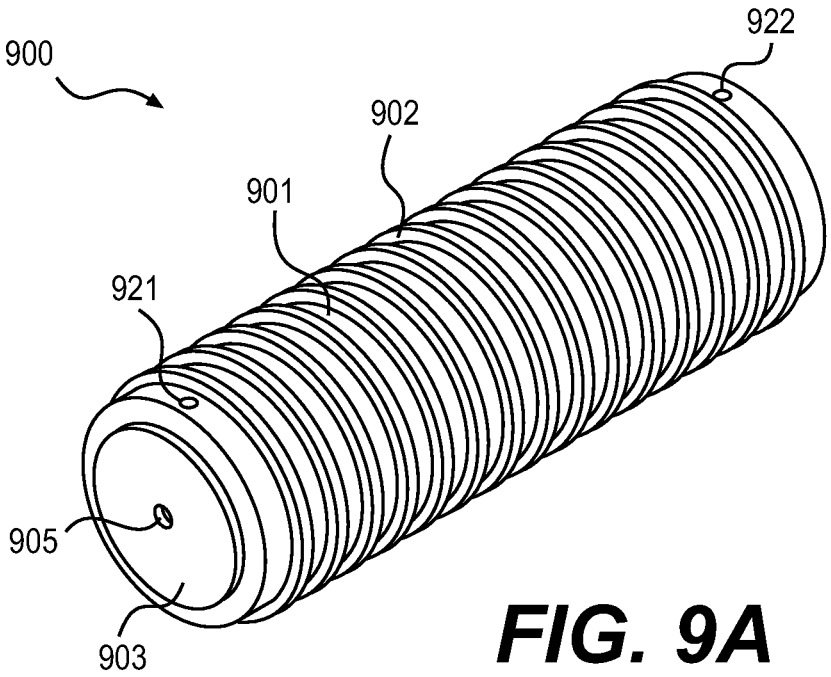
FIG. 9A is a schematic diagram of a perspective view of another embodiment of an ion optical element that may be used as an ion guide, a collision cell or a reaction cell.

FIG. 9A is a perspective schematic diagram of an ion optical element 900 with a series of circumferential ring electrodes 902 encircling outer ceramic tube 901. This embodiment would typically have at least five circumferential ring electrodes, and would preferably have several more than five circumferential ring electrodes. Ion optical element 900 has an entrance plate 903 with an orifice 905 in its center, and an exit plate 906 with an orifice 907 at its center. Port 921 may be used to introduce a collision or reaction gas into inner chamber 930 within inner ceramic tube 904. Inner chamber 930 is bounded by the inner surface of inner ceramic tube 904, entrance plate 903 and exit plate 906. Port 922 may be used to mount a pressure gauge to measure the pressure inside the inner ceramic tube. As shown in the schematic cross-section shown in FIG. 9B, inner ceramic tube 904 is in close thermal contact with outer ceramic tube 901. Outer ceramic tube 901 has an embedded electric heater 908. Power supply 940 applies a DC voltage between entrance plate 903 and exit plate 906. Entrance plate 903 and exit plate 906 may be made of a conductive material such as stainless steel. The axial electric field established by DC power supply 940 between entrance plate 903 and exit plate 906 keeps the ions in chamber 930 moving axially from entrance hole 905 to exit hole 907.

Circumferential ring electrodes 902 and 912 are electrically connected to RF source 950. They guide the ions through ion optical element 900 by confining the ions radially. RF source 950 is electrically connected to circumferential electrodes 902 via capacitor 951 and electrical connections 952. RF source 950 is electrically connected to circumferential electrodes 912 via capacitor 953 and electrical connections 954.

Figure 9B:
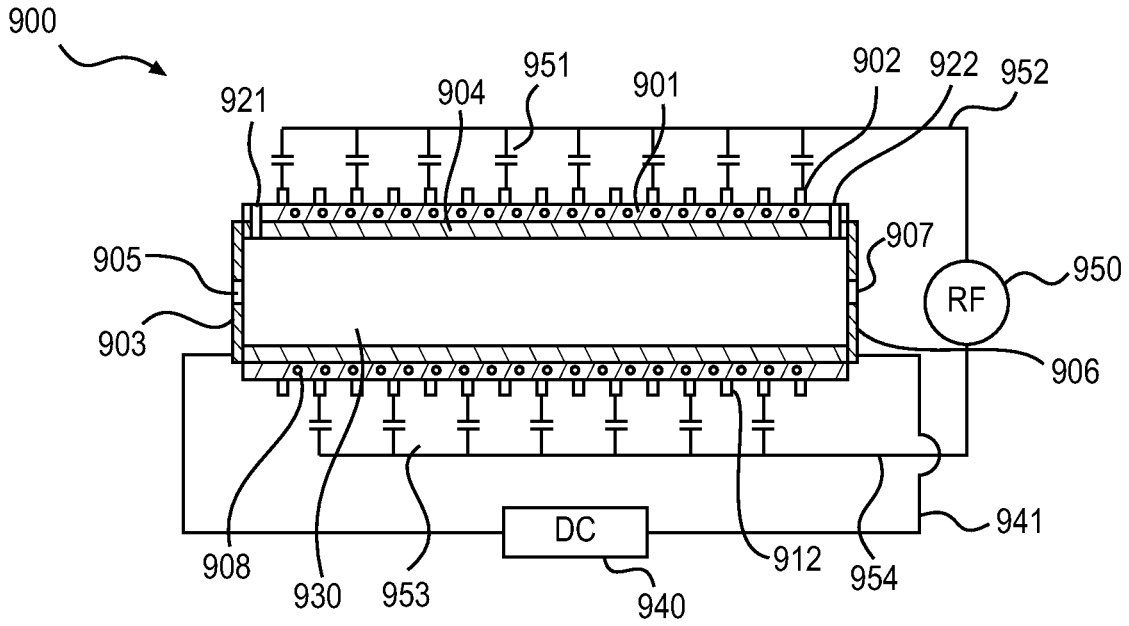
FIG. 9B is a schematic diagram of a cross-sectional view of the embodiment of FIG. 9A.
Figure 10A:
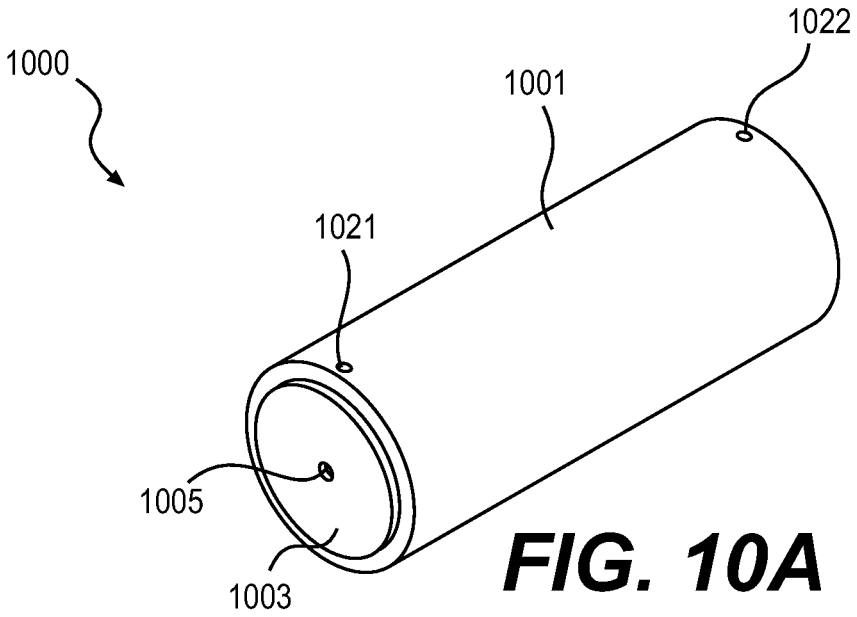
FIG. 10A is a schematic diagram of a perspective view of another embodiment of an ion optical element that may be used as an ion guide, a collision cell or a reaction cell.
Figure 10B:
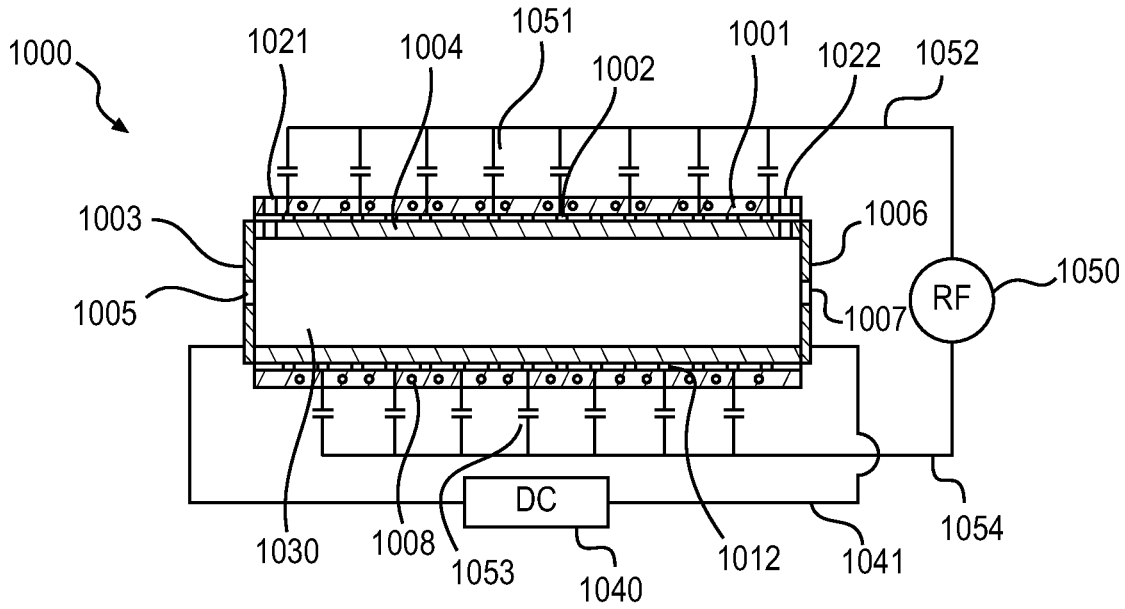
FIG. 10B is a schematic diagram of a cross-sectional view of the embodiment of FIG. 10A.

FIGS. 10A and 10B are schematic diagrams of another embodiment of an ion optical element that uses circumferential electrodes. This embodiment is generally similar to the embodiment shown in FIG. 9, but in this case the circumferential electrodes 1002 and 1012 are placed between outer ceramic tube 1001 and inner ceramic tube 1004. This embodiment would typically have at least five circumferential ring electrodes, and would preferably have several more than five circumferential ring electrodes. Because circumferential ring electrodes 1002 and 1012 are AC-coupled to the RF source, they can be in contact with the inner ceramic tube without interfering with the establishment of the axial DC gradient by power supply 1040 across the length of the inner ceramic tube. The RF signal from RF source 1050 is applied at a first polarity via capacitor 1051 and electrical connections 1052 to the first set of circumferential electrodes 1002, and via capacitor 1053 and electrical connections 1054 at a second polarity (which is 180° out-of-phase with the first polarity) to the second set of circumferential electrodes 1012.

Otherwise, the embodiment of FIG. 10A and FIG. 10B is generally similar to the embodiment of FIGS. 9A and 9B. This embodiment has an outer ceramic tube made of the second ceramic material 1001. It also has an inner ceramic tube 1004 positioned concentrically within and in close thermal contact with the outer ceramic tube 1001. Inner ceramic tube 1004 has an entrance plate 1003 that has an orifice 1005 at its center. It has an exit plate 1006 with an orifice 1007 at its center. Entrance plate 1003 and exit plate 1006 may be made from a conductive material such as stainless steel. Outer ceramic tube 1001 has an embedded electrical heater 1008 that may be used to heat outer ceramic tube 1001 and inner ceramic tube 1004 made of the first ceramic material to an elevated temperature. The interior surface of inner ceramic tube 1004, entrance plate 1003 and exit plate 1006 form the boundaries of inner chamber 1030. At the elevated temperature, the resistivity of the first ceramic material is such that the inner ceramic tube has a current flowing from its entrance end to its exit end, as a result of the DC voltage imposed by power supply 1040. However, that resistivity is still high enough such that it does not prevent the RF field imposed by electrodes 1002 and/or 1012 from penetrating substantially through the walls of inner ceramic tube 1004 and into inner chamber 1030 so as to be effective in guiding ions through inner chamber 1030. For yttria-stabilized zirconia with about an 8% yttria component, a typical operating temperature could be in the range of 100° C. to 150° C. for RF frequencies of 0.5 MHz to 3 MHz.

When used as a collision cell or as a reaction cell, ion optical element 1000 has an input port 1021 for injection of the collision or reaction gas. It may optionally also have an additional port 1022 that may be connected to, for example, a pressure gauge.

Figure 11A:
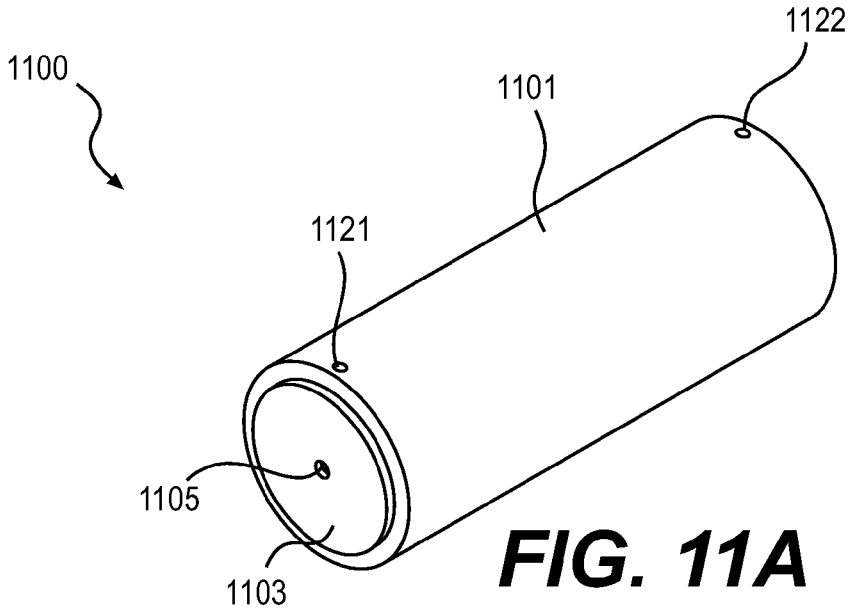
FIG. 11A is a schematic diagram of a perspective view of another embodiment of an ion optical element that may be used as an ion guide, a collision cell or a reaction cell.
Figure 11B:
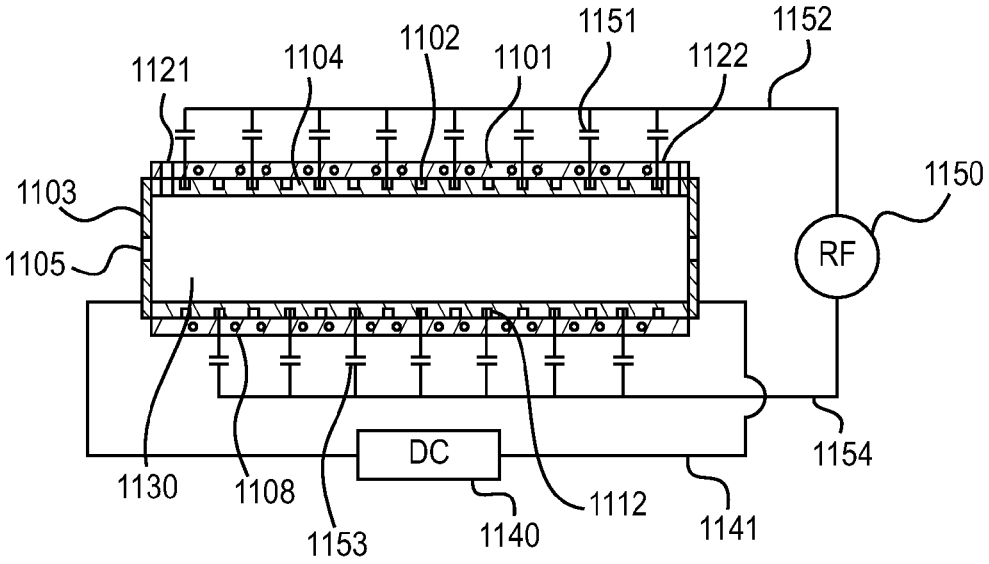
FIG. 11B is a schematic diagram of a cross-sectional view of the embodiment of FIG. 11A.

FIGS. 11A and 11B are schematic diagrams of another embodiment of an ion optical element that uses circumferential electrodes. This embodiment is generally similar to the embodiment shown in FIG. 10A and FIG. 10B, but in this case the circumferential electrodes 1102 and 1112 are embedded in inner ceramic tube 1104. This embodiment would typically have at least five circumferential ring electrodes, and would preferably have several more than five circumferential ring electrodes. Because circumferential ring electrodes 1102 and 1112 are AC-coupled to the RF source, they can be in contact with the inner ceramic tube without interfering with the establishment of the axial DC gradient by power supply 1140 across the length of the inner ceramic tube. The RF signal from RF source 1150 is applied at a first polarity via capacitor 1151 and electrical connections 1152 to the first set of circumferential electrodes 1102, and via capacitor 1153 and electrical connections 1154 at a second polarity (which is 180° out-of-phase with the first polarity) to the second set of circumferential electrodes 1112.

Otherwise, the embodiment of FIG. 11A and FIG. 11B is generally similar to the embodiments of FIGS. 9A and 9B and FIGS. 10A and 10B. This embodiment has an outer ceramic tube made of the second ceramic material 1101, and an inner ceramic tube 1104 concentrically within and in close thermal contact with outer ceramic tube 1101. Inner ceramic tube 1104 has an entrance plate 1103 at its entrance end that has an orifice 1105 at its center. It has an exit plate 1106 at its exit end with an orifice 1107 at its center. Entrance plate 1103 and exit plate 1106 are made of a conductive material such a stainless steel.

Outer ceramic tube 1101 has an embedded electrical heater 1108 that may be used to heat outer ceramic tube 1101 (made of the second ceramic material) and inner ceramic tube 1104 (made of the first ceramic material) to an elevated temperature. The interior surface of inner ceramic tube 1104, entrance plate 1103 and exit plate 1106 form the boundaries of inner chamber 1130. At that elevated temperature, the resistivity of the first ceramic material is such that the inner ceramic tube has a current flowing from its entrance end to its exit end, as a result of the DC voltage imposed by power supply 1140. However, that resistivity is still high enough such that it does not prevent the RF field imposed by electrodes 1102 and 1112 from penetrating through the walls of inner ceramic tube 1104 and into inner chamber 1130.

When used as a collision cell or as a reaction cell, ion optical element 1100 has an input port 1121 for injection of the collision or reaction gas. It may optionally also have an additional port 1122 that may be connected to, for example, a pressure gauge.

The structures described in FIGS. 8A through 11C can also be used, with additional electrical power supplies, as Travelling Wave ion guides as described, for example, in U.S. Pat. No. 6,812,453, which is incorporated by reference herein in its entirety. Also, these structures are not limited to linear geometries. For example, these structures may be used in an MS/MS instrument with a collision cell that forms part of an arc of a circle and enables a more compact geometry for the entire instrument. Such an instrument is described, for example, in U.S. Pat. No. 6,576,897, which is incorporated by reference herein in its entirety. These structures may also be used in instruments with spiral geometries, such as the structures with spiral geometries described in U.S. Pat. No. 8,552,366, which is incorporated by reference herein in its entirety.

The configuration of the circumferential electrodes in the embodiments of FIGS. 10A and 10B, and FIGS. 11A and 11B may result in a stronger RF field being present inside the tube for a given applied RF voltage, than in embodiments in which the electrodes encircle the outer ceramic tube, such as those in the embodiments of FIGS. 9A and 9B. These electrodes may be made of stainless steel, silver, gold or aluminum, for example.

As used herein, "substantially aligned" shall mean aligned within standard engineering tolerances in the field of mass spectrometry; "substantially uniform" as applied to an electric field shall mean sufficiently uniform to direct ions towards the exit end or opposite end of the ion optical element; and "substantially penetrates" shall mean penetrates sufficiently to be effective in guiding the ions through the ion optical element.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An ion optical element comprising:

an outer ceramic tube made of a second ceramic material;

an inner ceramic tube made of a first ceramic material within and concentric to the outer ceramic tube, wherein the inner ceramic tube fits closely within the outer ceramic tube and is in thermal contact with the outer ceramic tube;

an electric heater configured to heat the outer ceramic tube;

a first conductive element at an entrance end of the inner ceramic tube;

a DC voltage power supply applying a DC voltage between the entrance end of the inner ceramic tube and an opposite end of the inner ceramic tube, wherein the first ceramic material is characterized by a first room temperature electrical resistivity and a first room temperature thermal conductivity, and wherein the second ceramic material is characterized by a second room temperature electrical resistivity and a second room temperature thermal conductivity, and wherein the second room temperature electrical resistivity is higher than the first room temperature electrical resistivity by at least two orders of magnitude.

2. The ion optical element of claim 1, wherein the second room temperature thermal conductivity is higher than the first room temperature thermal conductivity by at least about an order of magnitude.

3. The ion optical element of claim 1, further comprising an entrance ring electrode mounted to the entrance end of the inner ceramic tube.

4. The ion optical element of claim 3, further comprising an opposite end ring electrode mounted to the opposite end of the inner ceramic tube.

5. The ion optical element of claim 1, further comprising a second conductive element at the opposite end of the inner ceramic tube.

6. The ion optical element of claim 1, wherein the electrical resistivity of the second ceramic material is at least two orders of magnitude higher than the electrical resistivity of the first ceramic material from room temperature up to 225° C.

7. The ion optical element of claim 1, wherein the thermal conductivity of the second ceramic material is at least an order of magnitude higher than the thermal conductivity of the first ceramic material from room temperature up to 225° C.

8. The ion optical element of claim 1, wherein the first ceramic material is one of zirconia and a blended zirconia material.

9. The ion optical element of claim 1, wherein the first ceramic material is an yttria-blended zirconia material.

10. The ion optical element of claim 1, wherein the second ceramic material is one of aluminum nitride and a composite sintered body of aluminum nitride and boron nitride.

11. The ion optical element of claim 1, wherein at room temperature the second ceramic material has an electrical resistivity above about $10^{12}$ Ω-cm and a thermal conductivity above about 70 W/m-K.

12. The ion optical element of claim 1, wherein the first ceramic material has a room temperature electrical resistivity above about $10^{6}$ Ω-cm and a thermal conductivity above about 2 W/m-K.

13. A reflectron for a mass spectrometer comprising:

an outer ceramic tube comprising an electric heater;

an inner tube within the outer ceramic tube and in close thermal contact with the outer ceramic tube, wherein the inner tube is comprised of at least five sets of alternating metal ring electrodes and ceramic rings;

an entrance grid at an entrance end of the inner ceramic tube;

an end plate at an opposite end of the inner ceramic tube;

a high voltage power supply applying a high voltage between the entrance grid and the end plate, wherein the high voltage is selected such that the end plate repels ions, wherein the ceramic rings are made of a first ceramic material that is characterized by a first room temperature electrical resistivity and by a first room temperature thermal conductivity, and the outer ceramic tube is made of a second ceramic material that is characterized by a second room temperature electrical resistivity and a second room temperature thermal conductivity, and wherein the second room temperature electrical resistivity is higher than the first room temperature electrical resistivity by at least two orders of magnitude.

14. The reflectron of claim 13, wherein the plurality of alternating metal ring electrodes and ceramic rings is at least five alternating metal ring electrodes and ceramic rings.

15. The reflectron of claim 13, wherein the electrical resistivity of the second ceramic material is at least two orders of magnitude higher than the electrical resistivity of the first ceramic material from room temperature up to 225° C.

16. The reflectron of claim 13, wherein the second room temperature thermal conductivity is higher than the first room temperature thermal conductivity by at least one order of magnitude.

17. The reflectron of claim 13, wherein the thermal conductivity of the second ceramic material is at least an order of magnitude higher than the thermal conductivity of the first ceramic material from room temperature up to 225° C.

18. The reflectron of claim 13, wherein the first ceramic material is one of zirconia and a blended zirconia material, and wherein the second room temperature thermal conductivity is higher than the first room temperature thermal conductivity by at least one order of magnitude.

19. The reflectron of claim 13, wherein the second ceramic material is one of aluminum nitride and a composite sintered body of aluminum nitride and boron nitride.

20. The ion reflectron of claim 13, wherein at room temperature the second ceramic material has an electrical resistivity above about $10^{12}$ Ω-cm and a thermal conductivity above about 70 W/m-K.

21. The reflectron of claim 13, wherein the first ceramic material has a room temperature electrical resistivity above about $10^{6}$ Ω-cm and a thermal conductivity above about 2 W/m-K.

* * * * *